US009448005B2

(12) United States Patent
Lee et al.

(10) Patent No.: US 9,448,005 B2
(45) Date of Patent: Sep. 20, 2016

(54) GUARD ASSEMBLY AND REFRIGERATOR INCLUDING THE SAME

(71) Applicant: SAMSUNG ELECTRONICS CO., LTD., Suwon-si, Gyeonggi-do (KR)

(72) Inventors: Tae Youl Lee, Changwon-si (KR); Byoung Mok Kim, Gwangju (KR); Hyo Sik Kang, Gwangju (KR); Dae Young Kim, Gwangju (KR); Jong Sun Park, Gyeonggi-do (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/591,414

(22) Filed: Jan. 7, 2015

(65) Prior Publication Data

US 2015/0192353 A1 Jul. 9, 2015

(30) Foreign Application Priority Data

Jan. 7, 2014 (KR) ..... 10-2014-0002067
May 12, 2014 (KR) ..... 10-2014-0056370

(51) Int. Cl.
*A47B 96/04* (2006.01)
*F25D 23/02* (2006.01)
*F25D 23/12* (2006.01)

(52) U.S. Cl.
CPC ..... *F25D 23/028* (2013.01); *F25D 23/126* (2013.01); *F25D 2323/021* (2013.01); *F25D 2323/024* (2013.01); *F25D 2400/361* (2013.01)

(58) Field of Classification Search
CPC ..... F25D 23/04
USPC ..... 312/405, 405.1, 321.5, 401, 404, 408; 62/440, 441
See application file for complete search history.

(56) References Cited

U.S. PATENT DOCUMENTS 2,894,379 A * 7/1959 Saunders ..... F25D 25/00 292/128
3,682,521 A * 8/1972 Kesling ..... A47B 57/10 297/153
5,685,624 A * 11/1997 Lee ..... F25D 23/04 312/274
7,469,980 B2 * 12/2008 Koo ..... F25D 23/04 312/321.5
7,472,974 B2 * 1/2009 Czach ..... A47B 88/18 312/321.5
7,748,805 B2 * 7/2010 Lucas ..... F25D 23/04 312/405.1
7,806,491 B2 * 10/2010 Lee ..... F25D 23/04 312/222
7,866,181 B2 * 1/2011 Lee ..... F25D 23/025 292/DIG. 37

* cited by examiner

*Primary Examiner* — Matthew Ing
(74) *Attorney, Agent, or Firm* — Staas & Halsey LLP

(57) ABSTRACT

Provided are a guard assembly that is rotatably installed at a rear side of a door of a refrigerator and the refrigerator including the same. The guard assembly in accordance with an embodiment, is installed at a rear side of a door of a refrigerator. The guard assembly includes a body portion which is placed at the rear side of the door and to which a supporting tray is coupled, and a rotation unit that causes the body portion to be rotatably coupled to the door. The rotation unit includes a guide member having a coupling hole and coupled to one side of the rear side of the door, and a hinge member having one side coupled to the body portion and another side rotatably coupled to the coupling hole.

18 Claims, 38 Drawing Sheets

GUARD ASSEMBLY AND REFRIGERATOR INCLUDING THE SAME

CROSS-REFERENCE TO RELATED APPLICATIONS

This application claims the benefit of Korean Patent Application No. 10-2014-0002067 and 10-2014-0056370, filed on Jan. 7, 2014 and May 12, 2014 in the Korean Intellectual Property Office, respectively, the disclosures of which are incorporated herein by reference.

BACKGROUND

1. Field

Embodiments of the present invention relate to a guard assembly that is rotatably installed at a rear side of a door of a refrigerator and a refrigerator including the guard assembly.

2. Description of the Related Art

In general, a refrigerator is an apparatus that keeps food fresh by including a storage compartment in which food is stored and a cold air supplying unit for supplying cold air to the storage compartment. The storage compartment is opened/closed by a door, and a display unit is disposed at the door so as to display operating information of the refrigerator or receive operating instructions of the refrigerator.

A refrigerator is provided so that the display unit is hidden in the door so as to improve esthetic appealing of the exterior. In this case, a front plate of the door is formed of reinforced glass or a transparent resin material so that information displayed on the display unit may be transmitted to the outside through the front plate.

Also, the refrigerator includes an ice-making unit that generates ice according to a user's need and a dispenser that may dispense water or ice to the outside without opening the door.

In addition, the refrigerator may further include a carbonated water making device that is disposed at the dispenser so as to dispense carbonated water in addition to water and ice. In the carbonated water making device, a container in which carbon dioxide is accommodated, is coupled to a rear side of the door so that carbon dioxide used to make carbonated water can be supplied to the carbonated water making device. In this case, in the carbonated water making device, when carbon dioxide is exhausted in the container in which carbon dioxide is accommodated, the container is replaced with another container so that carbon dioxide can be continuously supplied to the carbonated water making device.

SUMMARY

Therefore, it is an aspect of an embodiment to provide a guard assembly having an improved structure in which a rear space of a door can be efficiently utilized and a refrigerator including the guard assembly.

It is another aspect of an embodiment to provide a guard assembly having an improved structure in which the guard assembly disposed at a rear side of a door can be rotated and a refrigerator including the guard assembly.

Additional aspects of the invention will be set forth in part in the description which follows and, in part, will be apparent from the description, or may be learned by practice of the invention.

In accordance with one aspect of an embodiment, a guard assembly installed at a rear side of a door of a refrigerator, includes a body portion which is placed at the rear side of the door and to which a supporting tray, and a rotation unit that causes the body portion to be rotatable coupled to the door. The rotation unit may include a guide member having a coupling hole and coupled to one side of the rear side of the door, and a hinge member having one side coupled to the body portion and another side rotatably coupled to the coupling hole.

The guide member may include: a guide body coupled to the one side of the rear side of the door; a first coupling portion having the coupling hole and installed at an upper portion of the guide body; and a second coupling portion having a coupling hole and installed at a lower portion of the guide body.

The first coupling portion and the second coupling portion may be disposed in a position in which the first coupling portion and the second coupling portion overlap, when viewed from an upward direction.

The hinge member may include: a first hinge having one side coupled to an upper portion of the body portion and another side rotatably coupled to the first coupling portion; and a second hinge having one side coupled to a lower portion of the body portion and another side rotatably coupled to the second coupling portion.

The hinge member may include: a hinge body coupled to the body portion; and a hinge coupling portion that extends from the hinge body and is rotatably inserted into the coupling hole, and the hinge coupling portion may have a rotation limitation portion that maintains rotation of the body portion at an angle.

The coupling hole may include a hanging portion disposed on a rotation path of the rotation limitation portion, the rotation limitation portion being hung in the hanging portion so that rotation of the body portion is maintained at an angle.

The rotation unit may further include a lever that is installed in a position of the body portion in which the lever faces the guide member and that adjusts the body portion to be coupled to or separated from the rear side of the door.

The lever may include: a lever coupling portion that is placed at an inside of the body portion and is provided to be coupled to or separated from one side of the rear side of the door; a handle that is disposed at an outside of the body portion and moves a position of the lever coupling portion; and a restoration member that restores the position of the lever coupling portion to a position.

In accordance with another aspect of an embodiment, a refrigerator includes: a body including an inner case and an outer case; a storage compartment which is placed at an inside of the body and of which a front side is enabled to open; a door that opens/closes the front side of the storage compartment; and a guard assembly installed at a rear side of the door. The guard assembly may include: a body portion which is placed at the rear side of the door and to which a supporting tray is coupled; and a rotation unit that causes the body portion to be rotatably coupled to the door, where the rotation unit may include: a guide member having a coupling hole and coupled to one side of the rear side of the door; and a hinge member having one side coupled to the body portion and another side rotatably coupled to the coupling hole.

The guide member may include: a guide body coupled to the one side of the rear side of the door; a first coupling portion having the coupling hole and installed at an upper portion of the guide body; and a second coupling portion having a coupling hole and installed at a lower portion of the guide body.

The first coupling portion and the second coupling portion may be disposed in a position in which the first coupling portion and the second coupling portion overlap, when viewed from an upward direction.

The hinge member may include: a first hinge having one side coupled to an upper portion of the body portion and another side rotatably coupled to the first coupling portion; and a second hinge having one side coupled to a lower portion of the body portion and another side rotatably coupled to the second coupling portion.

The hinge member may include: a hinge body coupled to the body portion; and a hinge coupling portion that extends from the hinge body and is rotatably inserted into the coupling hole, and the hinge coupling portion may have a rotation limitation portion that maintains rotation of the body portion at an angle.

The coupling hole may include a hanging portion disposed on a rotation path of the rotation limitation portion, the rotation limitation portion being hung in the hanging portion so that rotation of the body portion is maintained at the angle.

The rotation unit may further include a lever that is installed in a position of the body portion in which the lever faces the guide member and that adjusts the body portion to be coupled to or separated from the rear side of the door.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
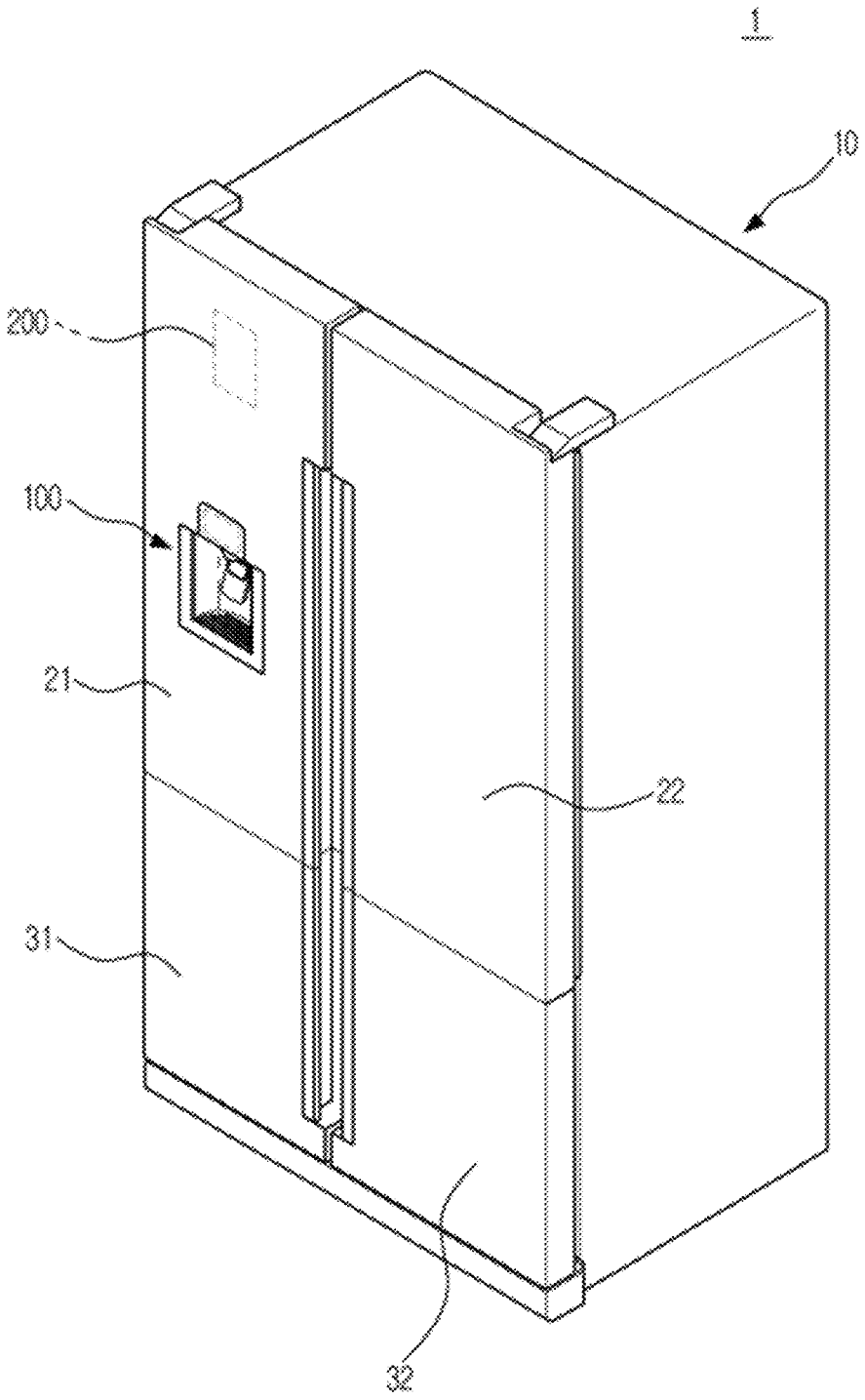
FIG. 1 is a perspective view illustrating an exterior of a refrigerator in accordance with an embodiment.

Reference will now be made in detail to the embodiments of the present invention, examples of which are illustrated in the accompanying drawings, wherein like reference numerals refer to like elements throughout.

Hereinafter, exemplary embodiments of the present invention will be described in detail.

Figure 2:
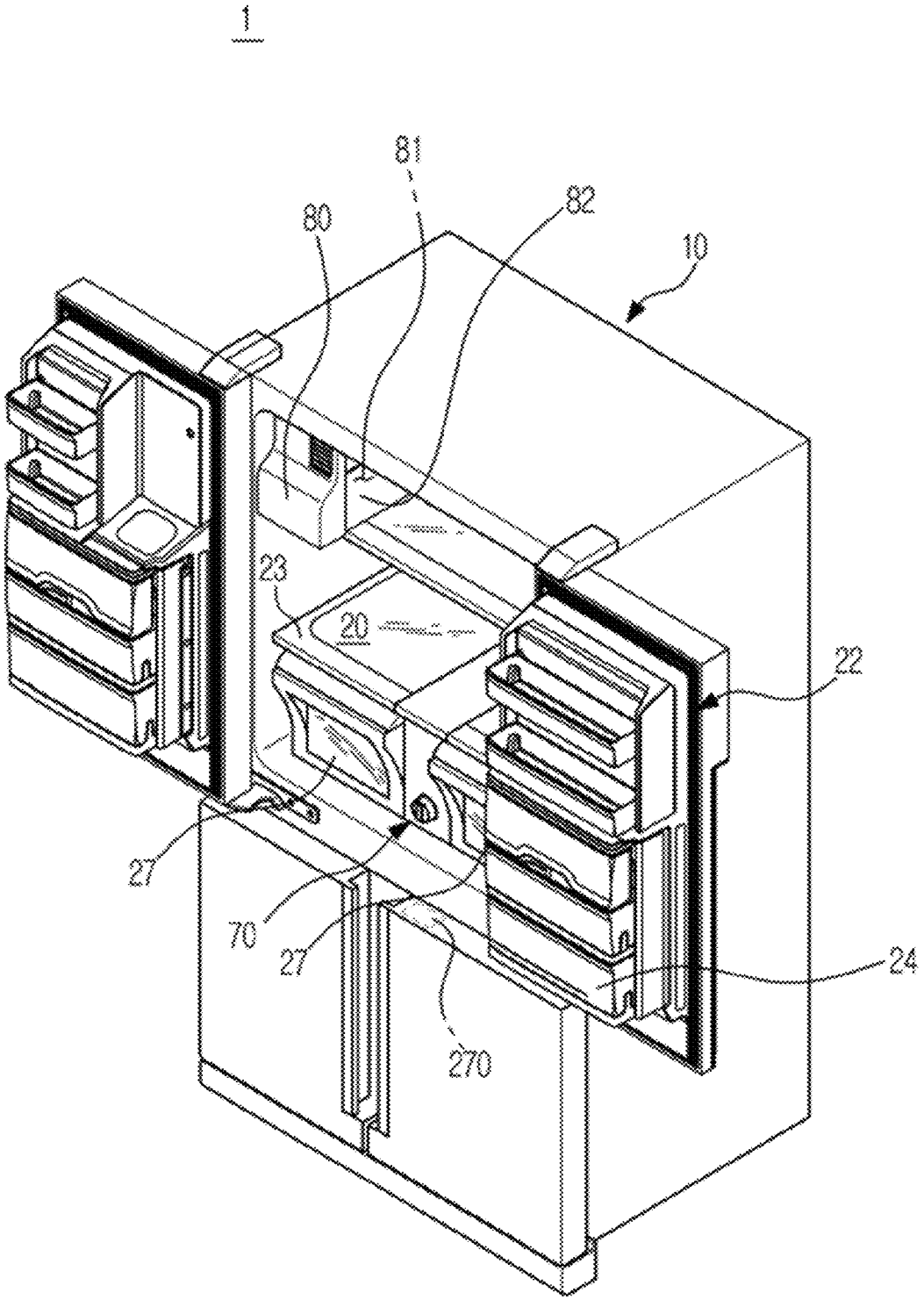
FIG. 2 is a perspective view in which an upper storage compartment of the refrigerator of FIG. 1 is opened.

FIG. 1 is a perspective view illustrating an exterior of a refrigerator in accordance with an embodiment of the present invention, and FIG. 2 is a perspective view in which an upper storage compartment of the refrigerator of FIG. 1 is opened.

Referring to FIGS. 1 and 2, a refrigerator 1 in accordance with an embodiment of the present invention includes a body 10, storage compartments 20 and 30 provided in the body 10, and a cold air supplying unit (not shown) that supplies cold air to the storage compartment 20 and compartment 30 (not shown).

The body 10 includes an inner case that constitutes the storage compartments 20 and 30, an outer case that is coupled to an outside of the inner case and constitutes the exterior of the refrigerator 1, and an insulating material that is disposed between the inner case and outer case and insulates the storage compartments 20 and 30.

The storage compartments 20 and 30 may be partitioned off into an upper refrigerator compartment 20 and a lower freezer compartment 30 by an intermediate barrier wall 17 (not shown). The upper refrigerator compartment 20 may be maintained at the temperature of about 3° C. so that food can be kept refrigerated, and the lower freezer compartment 30 may be maintained at the temperature of about −18.5° C. so that food can be kept frozen. A shelf 23 on which items such as food can be put, and at least one accommodation box 27 in which food is sealed and kept, may be provided in the refrigerator compartment 20.

Also, an ice making chamber 81 in which ice can be generated, may be formed at an upper corner of the refrigerator compartment 20 so as to be partitioned off from the upper refrigerator compartment 20 by an ice making chamber case 82. An ice making tray on which ice is generated, and an ice making device 80, such as an ice bucket in which ice generated in the ice making tray is stored, may be provided in the ice making chamber 81.

A water tank 70 in which water can be stored, may be provided in the refrigerator compartment 20. The water tank 70 may be provided among a plurality of accommodation boxes 27, as illustrated in FIG. 2. However, embodiments of the present invention are not limited thereto, and the water tank 70 may be provided in the refrigerator compartment 20 so that water in the water tank 70 can be cooled by cold air in the refrigerator compartment 20.

Figure 8:
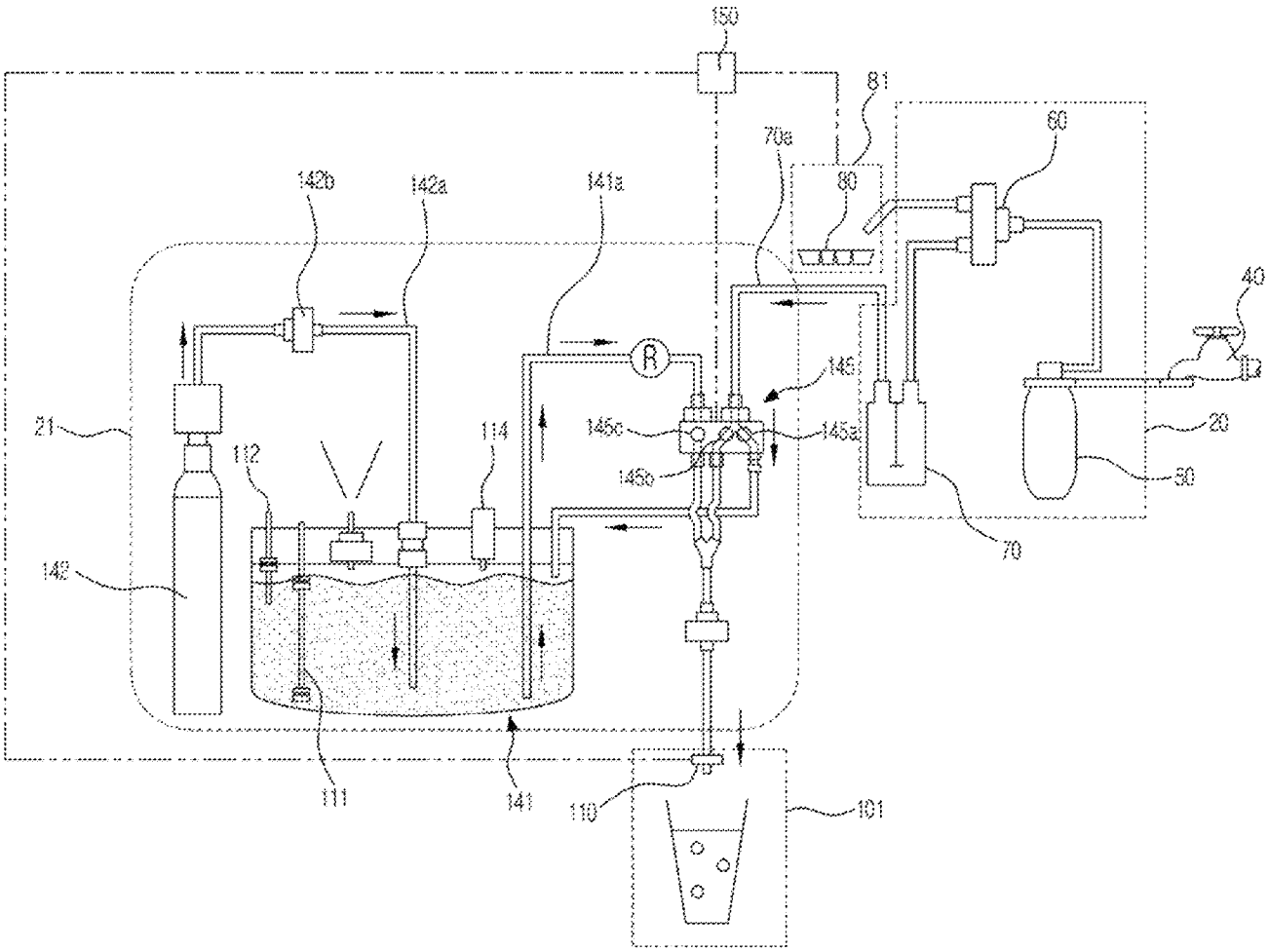
FIG. 8 is a conceptual view for describing an operation of making water, ice, and carbonated water and supplying the water, the ice, and the carbonated water to a dispenser using the refrigerator of FIG. 1.

The water tank 70 may be connected to an external water supply source (see 40, FIG. 8), such as waterworks, and may store purified water that is purified by a water-purifying filter (see 50, FIG. 8). A flow path changing valve 60 may be provided on a water supply conduit that connects the external water supply source 40 and the water tank 70, and water may be supplied to the ice making device 80 through the flow path changing valve 60.

Each of the refrigerator compartment 20 and the freezer compartment 30 has an opened front side through which food may be inserted into or taken out from the refrigerator compartment 20 and the freezer compartment 30. The opened front side of the refrigerator compartment 20 may be opened/closed by a pair of rotation doors 21 and 22 that are hinge-coupled to the body 10. The opened front side of the freezer compartment 30 may be opened/closed by a pair of rotation doors 31 and 32 that are hinge-coupled to the body 10. A door guard 24 in which food can be stored, may be provided to each of rear sides of the refrigerator compartment doors 21 and 22.

A gasket (not shown) may be provided at each of rear edges of the refrigerator compartment doors 21 and 22 so as to regulate cold air in the refrigerator compartment 20 by sealing a space between the refrigerator compartment doors 21 and 22 and the body 10 when the refrigerator compartment doors 21 and 22 are closed. Also, a rotation bar (not shown) may be provided at the refrigerator compartment door 21 of the refrigerator compartment doors 21 and 22 so as to control cold air in the refrigerator compartment 20 by sealing a space between the refrigerator compartment door 21 and the refrigerator compartment door 22 when the refrigerator compartment doors 21 and 22 are closed.

Also, a dispenser 100 that may dispense water or ice from the outside without opening the refrigerator compartment door 21, may be provided at the refrigerator compartment door 21 of the refrigerator compartment doors 21 and 22.

The dispenser 100 may include an intake space 101 (FIG. 8) in which a container, such as a cup, is inserted and water or ice may be obtained, a control panel 102 (FIG. 3) on which an input button for manipulating various settings of the dispenser 100 and a display for displaying various information of the dispenser 100 are disposed, and a lever unit 110 that may operate the dispenser 100 so that water, ice, and carbonated water can be selectively discharged.

Also, the dispenser 100 may include an ice chute 103 (FIG. 7) that connects the ice making device 80 and the intake space 101 so that ice generated by the ice making device 80 can be discharged into the intake space 101.

The intake space 101 is placed at an outside of the refrigerator compartment door 21. The ice chute 103 may be provided in a shape of a concave groove in a direction of an inside of the refrigerator compartment door 21.

The ice chute 103 is placed at an upper portion of the intake space 101. The ice chute 103 connects each of the water tank 70 placed in the refrigerator compartment 20, the ice making device 80, and a carbonated water making device 140 to the intake space 101. Thus, the ice chute 103 may be provided as a path on which water, ice, and carbonated water are moved into the intake space 101 from an inside of the refrigerator compartment 20.

Figure 3:
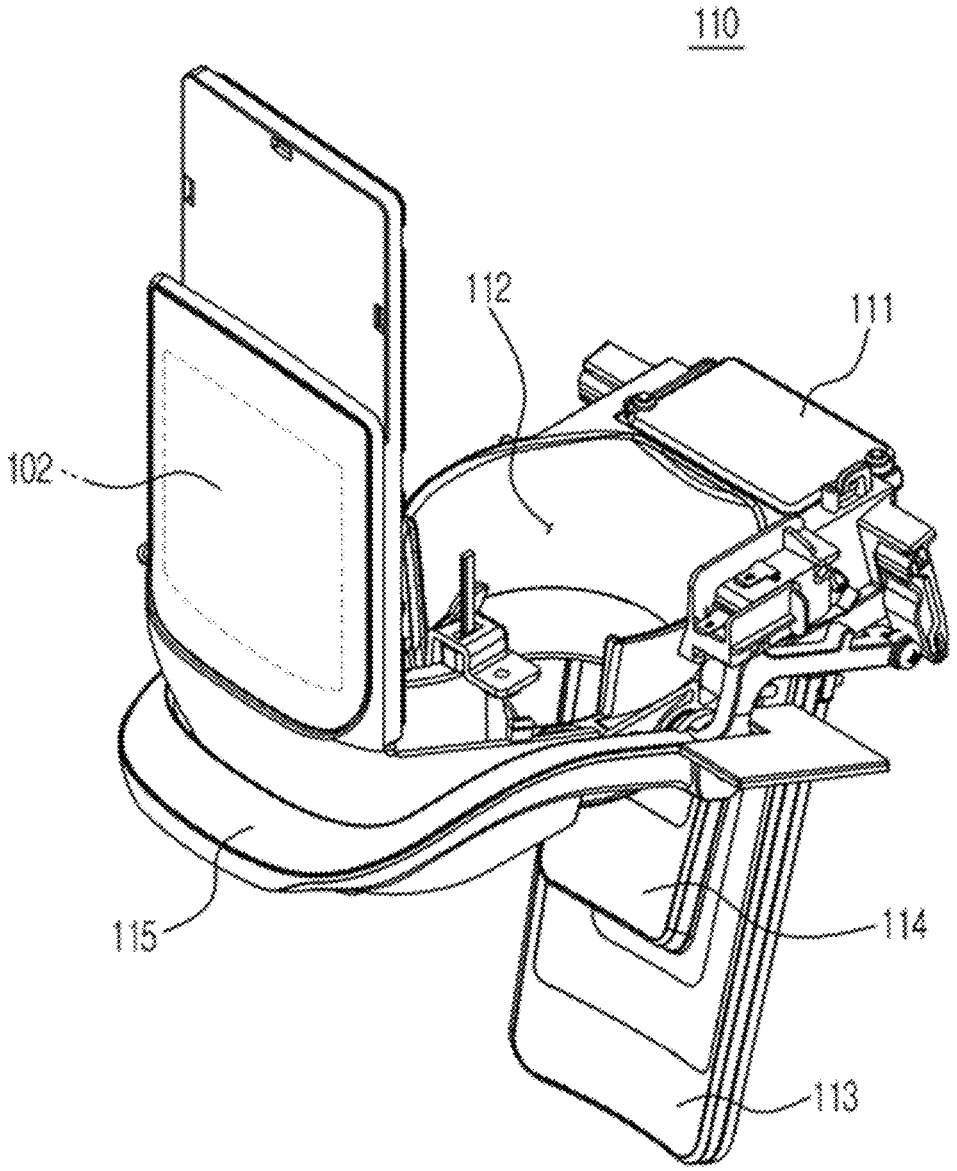
FIG. 3 is a perspective view of a lever unit of FIG. 1, in accordance with an embodiment.
Figure 4:
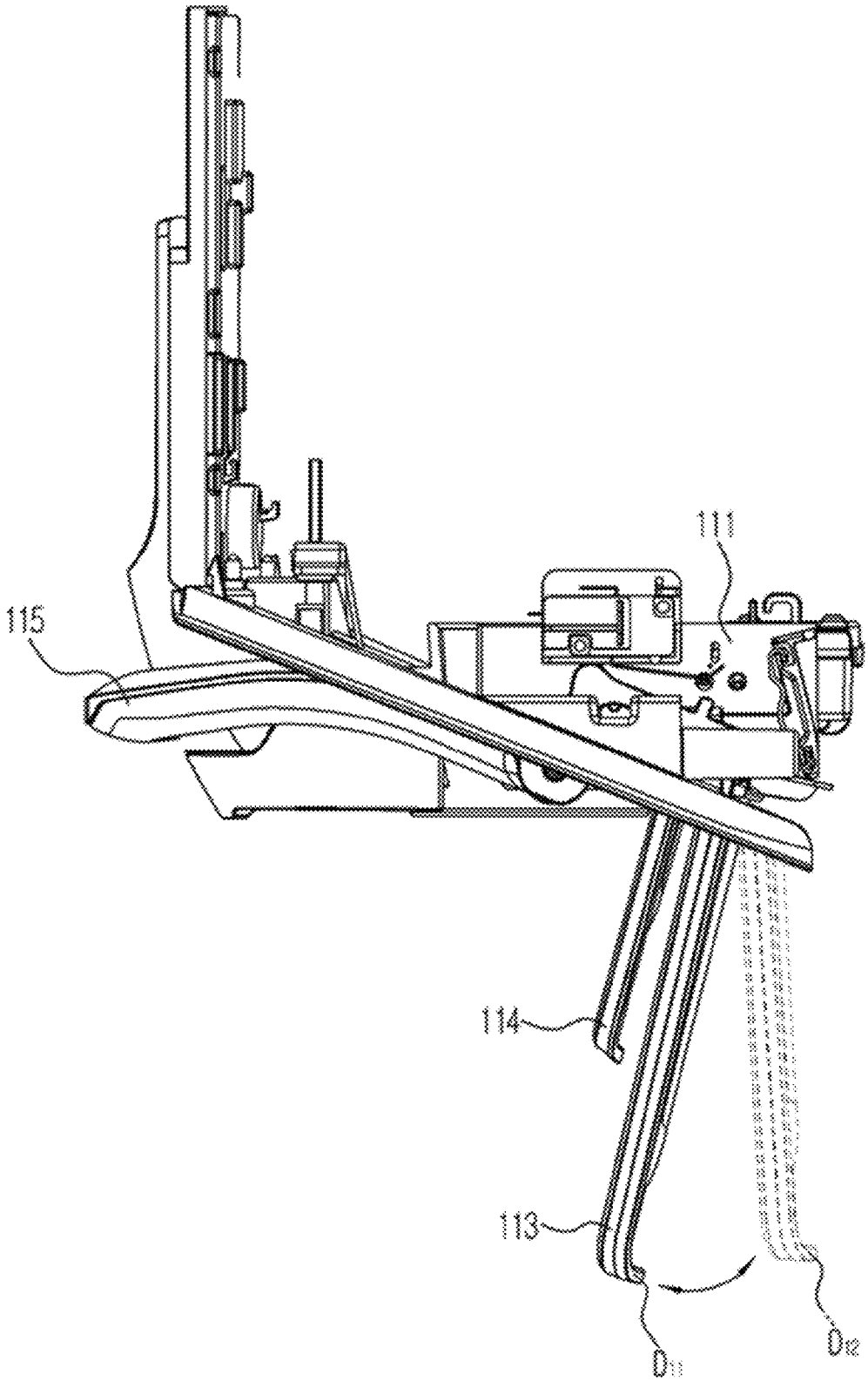
FIG. 4 is a side view of an operation of a first lever of FIG. 3.
Figure 5:
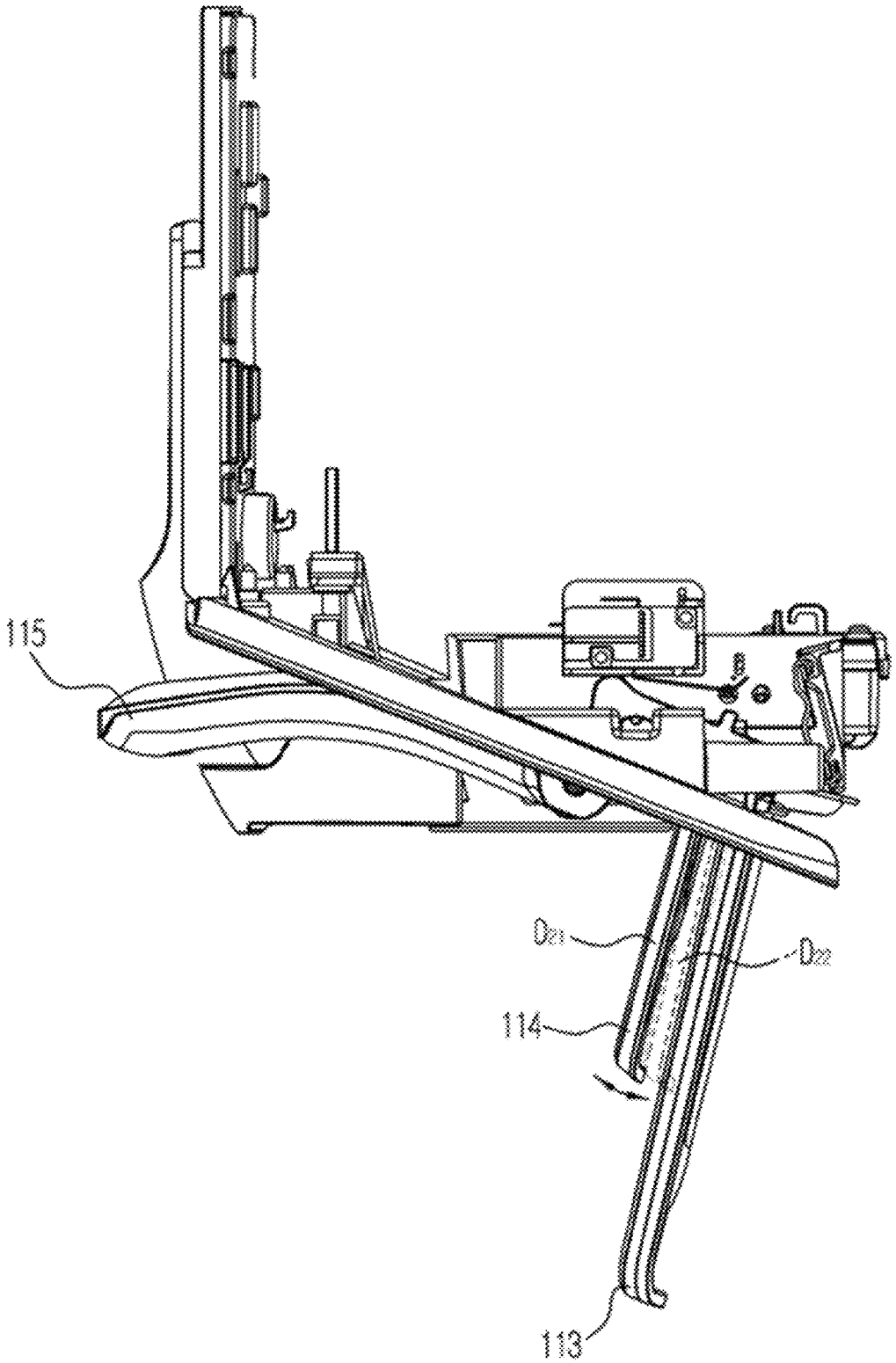
FIG. 5 is a side view of an operation of a second lever of FIG. 3.
Figure 6:
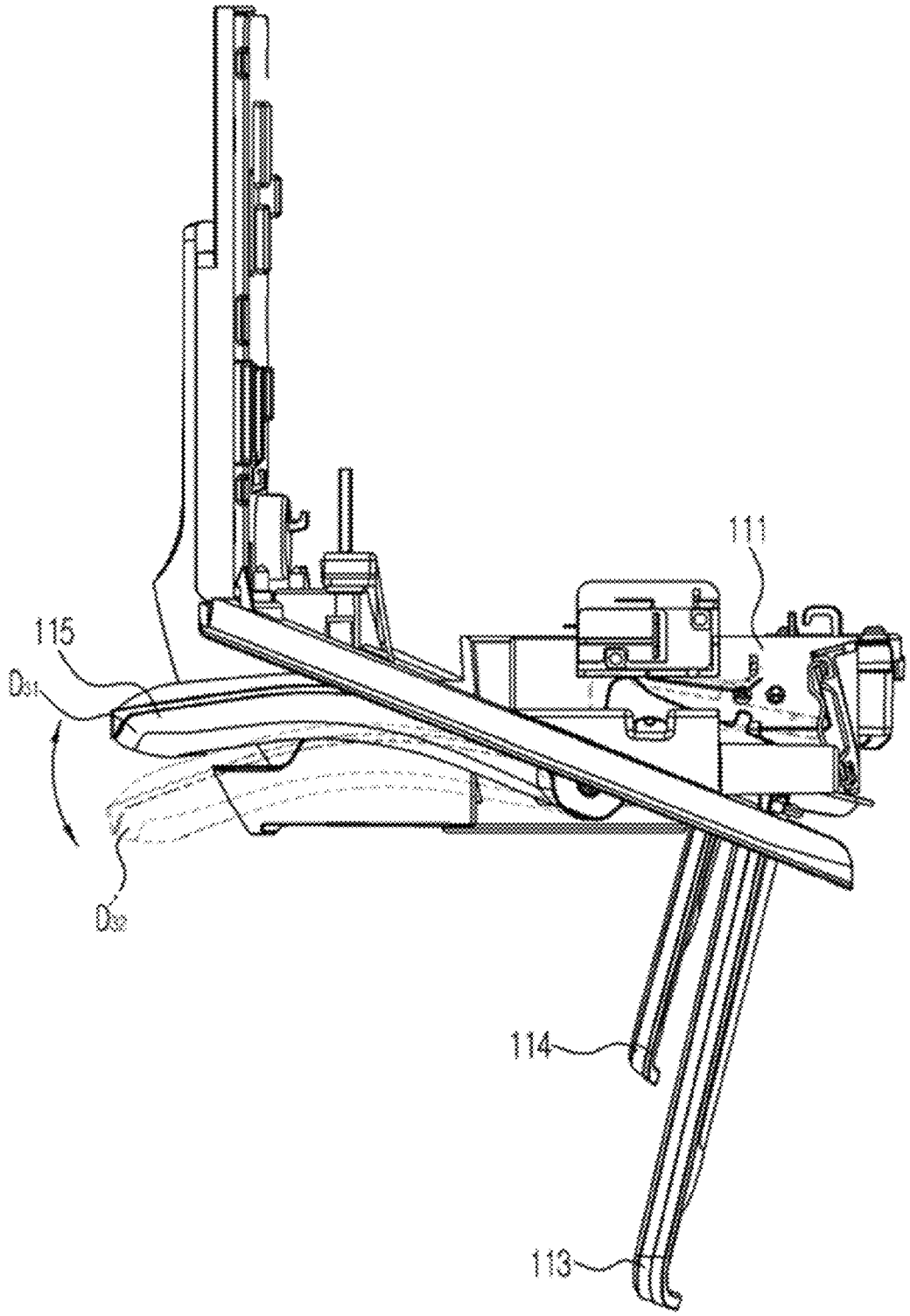
FIG. 6 is a side view of an operation of a third lever of FIG. 3.

FIG. 3 is a perspective view of a lever unit of FIG. 1, in accordance with an embodiment of the present invention, and FIG. 4 is a side view of an operation of a first lever of FIG. 3, and FIG. 5 is a side view of an operation of a second lever of FIG. 3, and FIG. 6 is a side view of an operation of a third lever of FIG. 3.

Referring to FIGS. 3, 4, 5 and 6, the lever unit 110 in accordance with an embodiment of the present invention may include a lever unit body portion 111, an ice discharging portion 112, a first lever 113, a second lever 114, and a third lever 115.

The lever unit body portion 111 is coupled to a top surface of the dispenser 100. One side of the first lever 113, one side of the second lever 114, and one side of the third lever 115 may be coupled to the lever unit body portion 111. The lever unit body portion 111 may include a control panel 102 having a front side on which a display is disposed. The control panel 102 having the front side on which the display is disposed, may display information of the refrigerator 1 including the state of the dispenser 100. The control panel 102 having the front side on which the display is disposed, may be provided in a different position from that of the lever unit body portion 111.

The lever unit body portion 111 includes the ice discharging portion 112. The ice discharging portion 112 may be provided in a central region of the lever unit body portion 111. The ice discharging portion 112 may serve as a path on which water, carbonated water, and ice are moved into the intake space 101 from the inside of the refrigerator compartment 20.

The first lever 113 may be placed in the intake space 101. The first lever 113 may be installed so that one side of the first lever 113 is fixed to the lever unit body portion 111. A fixed upper side of the first lever 113 may be placed in rear of the ice discharging portion 112. The first lever 113 may be provided to extend from the fixed upper side downwardly.

The first lever 113 may be provided to be rotated in a state in which a fixed top end of the first lever 113 is used as an axis. The first lever 113 may be provided to be rotated from a first position D11 to a second position D12. The first position D11 may be placed in front of the second position D12. The first lever 113 may include a restoration member (not shown). The restoration member (not shown) may move the first lever 113 that is placed between the first position D11 and the second position D12 to the first position D11. Thus, even when a user moves the first lever 113 from the first position D11, the first lever 113 may be restored to the first position D11. The restoration member (not shown) may include an elastic member.

According to an embodiment, the first lever 113 may be electrically connected to a controller (see 150, FIG. 8). The first lever 113 may transmit electrical signals to the controller (see 150, FIG. 8) whenever the first lever 113 is moved to the first position D11 or the second position D12. The controller (see 150, FIG. 8) may control the refrigerator 1 to perform a predetermined work according to a change in the position of the first lever 113.

The second lever 114 may be placed in the intake space 101. The second lever 114 may be installed so that one side of the second lever 114 is fixed to the lever unit body portion 111. The second lever 114 may be installed so that a fixed upper side of the second lever 114 may be placed in rear of the ice discharging portion 112. The second lever 114 may be installed so that the fixed upper side of the first lever 113 may be placed between the first lever 113 and the ice discharging portion 112. The second lever 114 may be provided to extend from the fixed upper side downwardly. The second lever 114 may be provided so that a bottom end of the second lever 114 may be higher than a bottom end of the first lever 113. The second lever 114 may be provided so that a length from the top end to the bottom end of the second lever 114 is shorter than that of the first lever 113.

The second lever 114 may be provided to be rotated in a state in which a fixed top end of the second lever 114 is used as an axis. The second lever 114 may be provided to be rotated from a third position D21 to a fourth position D22. The third position D21 may be placed in front of the fourth position D22. The second lever 114 may include a restoration member (not shown). The restoration member (not shown) may move the second lever 114 placed between the third position D21 and the fourth position D22 to the third position D21. Thus, even when the user moves the second lever 114 from the third position D21, the second lever 114 may be restored to the third position D21. The restoration member (not shown) may include an elastic member.

According to an embodiment, the second lever 114 may be electrically connected to the controller (see 150, FIG. 8). The second lever 114 may transmit electrical signals to the controller (see 150, FIG. 8) whenever the second lever 114 is moved to the third position D21 or the fourth position D22. The controller (see 150, FIG. 8) may control the refrigerator 1 to perform a predetermined work according to a change in the position of the second lever 114.

The third lever 115 may be placed in the intake space 101. The third lever 115 may be provided in a U shape. The third lever 115 may be installed so that both ends of the third lever 115 are fixed to the same height. The third lever 115 may be installed so that both ends of the third lever 115 are fixed to the lever unit body portion 111.

The third lever 115 may be provided to be rotatable when the fixed both ends of the third lever 115 are used as an axis. The third lever 115 may be provided to be rotatable from a fifth position D31 to a sixth position D32. The fifth position D31 may be provided at a higher position than the sixth position D32. The third lever 115 is placed in a stopped state only in the fifth position D31 and the sixth position D32. If the third lever 115 escapes from the fifth position D31, the third lever 115 is automatically moved to the sixth position D32. Also, if the third lever 115 escapes from the sixth position D32, the third lever 115 is automatically moved to the fifth position D31.

According to an example, the third lever 115 may be electrically connected to the controller (see 150, FIG. 8). The third lever 115 may transmit electrical signals to the controller (see 150, FIG. 8) whenever the third lever 115 is moved to the fifth position D31 or the sixth position D32. The controller (see 150, FIG. 8) may control the refrigerator 1 to perform a predetermined work according to a change in the position of the third lever 115.

The carbonated water making device 140 that makes carbonated water may be mounted on a rear side of the refrigerator compartment door 21 in which the dispenser 100 of the refrigerator 1 in accordance with an embodiment of the present invention is disposed. The carbonated water making device 140 may make carbonated water in the refrigerator 1.

Figure 7:
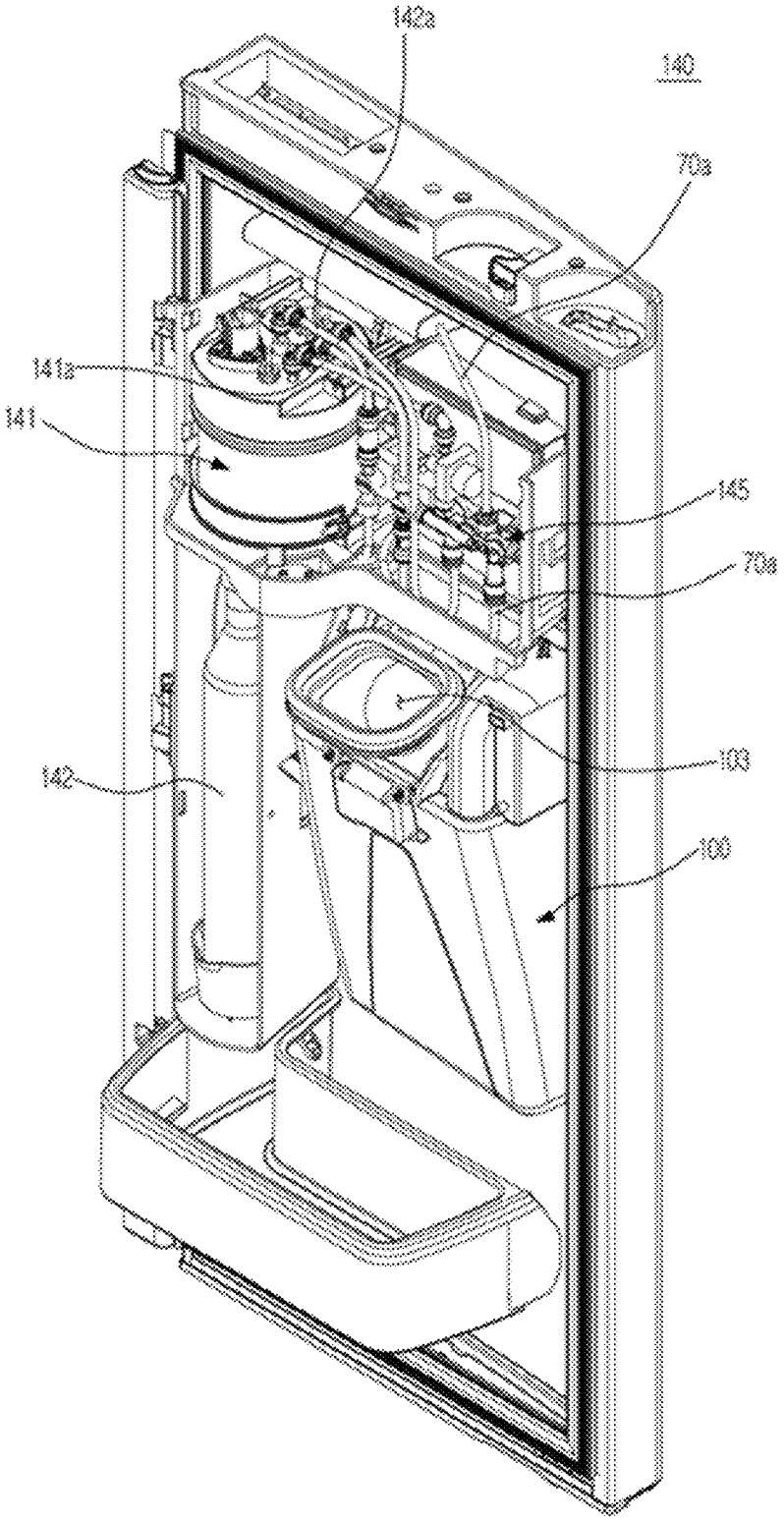
FIG. 7 is a perspective view of a carbonated water making device of the refrigerator of FIG. 1.

FIG. 7 is a perspective view of a carbonated water making device of the refrigerator of FIG. 1, and FIG. 8 is a conceptual view for describing an operation of making water, ice, and carbonated water and supplying the water, the ice, and the carbonated water to a dispenser using the refrigerator of FIG. 1.

Referring to FIGS. 7 and 8, water is supplied from the external water supply source 40. Water may be moved from the external water supply source 40 to the water-purifying filter 50. Purified water is moved from the water-purifying filter 50 to the flow path changing valve 60. The flow path changing valve 60 may selectively move the purified water to the ice making device 80 and the water tank 70. Ice is made from water moved into the ice making chamber 81.

The water moved to the water tank 70 is moved to a valve assembly 145 through a water-purifying supply flow path 70*a*. The purified water may be moved from the valve assembly 145 to a carbonated water tank 141 through a water-purifying supply valve 145*a* or may be moved to the intake space 101 of the dispenser 100 through a water-purifying discharge valve 145*b*. The water moved to the carbonated water tank 141 may be coupled to carbon dioxide moved to the carbonated water tank 141 through a separate flow path, thereby carbonated water may be made.

Carbon dioxide is supplied into a carbon dioxide gas cylinder 142. According to an example, the carbon dioxide gas cylinder 142 may be provided to be exchangeable. The carbon dioxide gas cylinder 142 may be replaced with another carbon dioxide gas cylinder 142 and may supply carbon dioxide if carbon dioxide in the carbon dioxide gas cylinder 142 is exhausted.

Carbon dioxide is moved from the carbon dioxide gas cylinder 142 to the carbonated water tank 141 through a carbon dioxide supply flow path 142*a*. A carbon dioxide supply valve 142*b* may be provided to the carbon dioxide supply flow path 142*a*. The carbon dioxide supply valve 142*b* may adjust the amount of carbon dioxide that passes through the carbon dioxide supply flow path 142*a*. Carbon dioxide is supplied into the water stored in the carbonated water tank 141 through the carbon dioxide supply flow path 142*a*. Through this procedure, carbonated water may be made.

The carbonated water is moved to the valve assembly 145 through a carbonated water discharge flow path 141*a*. A carbonated water discharge valve 145*c* of the valve assembly 145 controls carbonated water supplied to the dispenser 100.

According to an example, the controller 150 may be electrically connected to the lever unit 110, the valve assembly 145, and the ice making device 80. The lever unit 110 may transmit operating signals of the first lever 113, the second lever 114, and the third lever 115 to a controlling device. The controller 150 may control whether the valve assembly 145 and the ice making device 80 operate, using the signals transmitted from the lever unit 110.

The controller 150 may control the valve assembly 145 to adjust the water-purifying discharge valve 145*b* and the carbonated water discharge valve 145*c* and to selectively provide one of carbonated water, purified water, and ice to the intake space 101.

According to an example, the third lever 115 may adjust whether carbonated water is discharged. When the third lever 115 is placed in the fifth position D31, the controller 150 may block the carbonated water discharge valve 145*c*. In this case, when the first lever 113 is moved to the second position D12, the controller 150 may control the water to be moved to the intake space 101. Also, when the second lever 114 is moved to the fourth position D22, the controller 150 may control the ice to be moved to the intake space 101.

Also, when the third lever 115 is placed in the sixth position D32, the controller 150 may open the carbonated water discharge valve 145*c*. In this case, when the first lever 113 is moved to the second position D12 or the second lever 114 is moved to the fourth position D22, the controller 150 may control the carbonated water to be moved to the intake space 101.

When the third lever 115 is placed in the sixth position D32, the controller 150 may control the water to be moved to the intake space 101 when the first lever 113 is moved to the second position D12, and the controller 150 may control the carbonated water to be moved to the intake space 101 when the second lever 114 is moved to the fourth position D22. Also, when the third lever 115 is placed in the sixth position D32, the controller 150 may control the carbonated water to be moved to the intake space 101 when the first lever 113 is moved to the second position D12 and may control the ice to be moved to the intake space 101 when the second lever 114 is moved to the fourth position D22.

Figure 9:
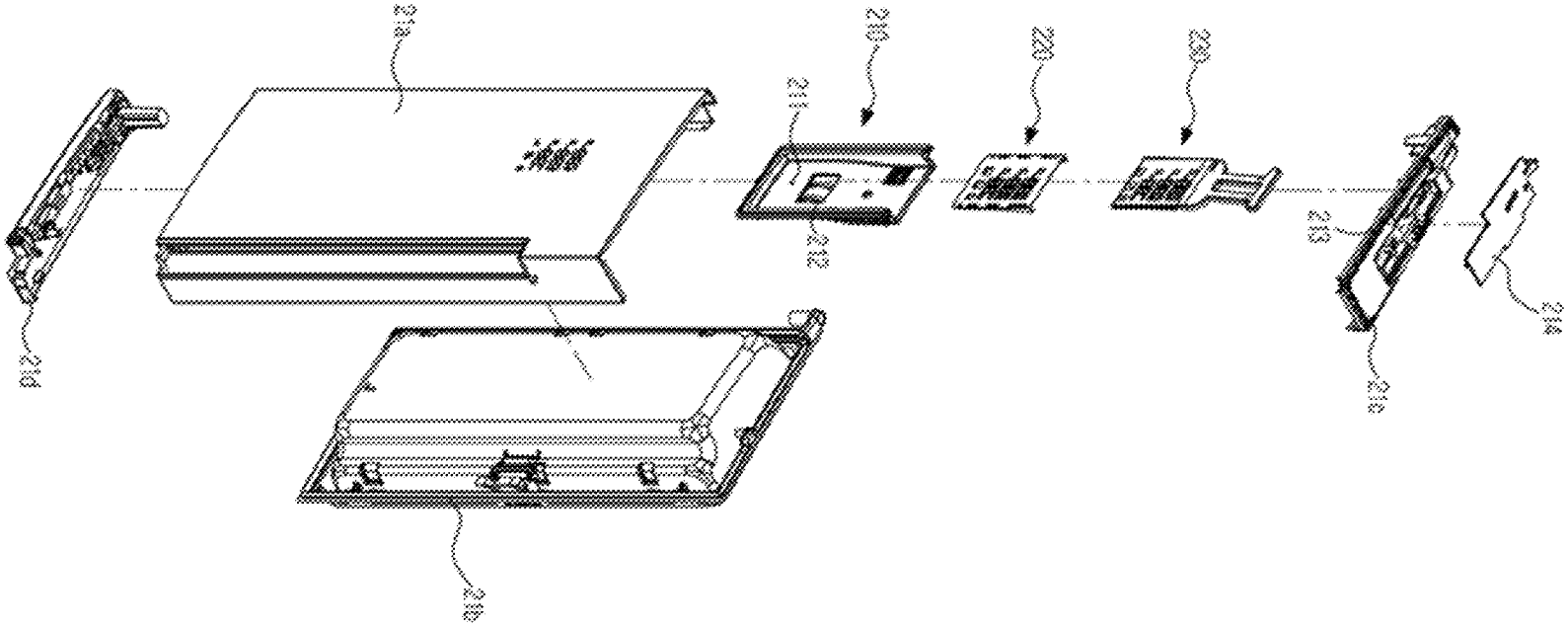
FIG. 9 is a schematic exploded perspective view of a door and a display assembly of the refrigerator of FIG. 1.
Figure 10:
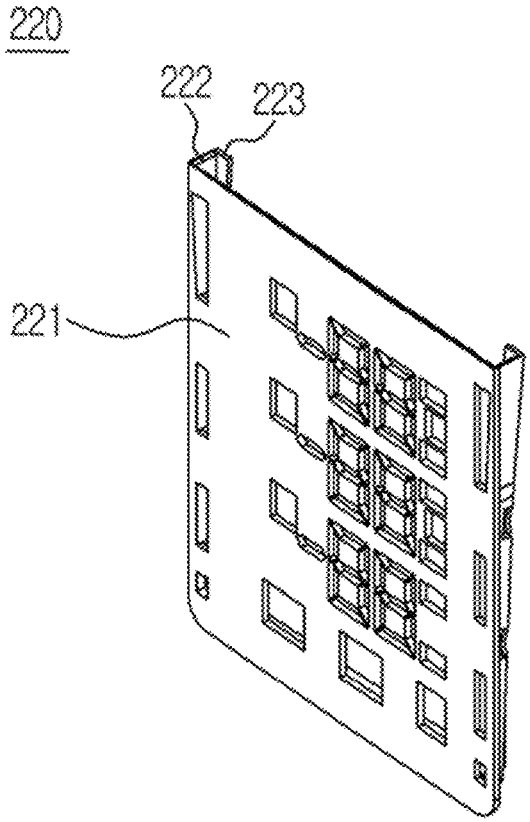
FIG. 10 is a perspective view of a display housing of FIG. 9.
Figure 11:
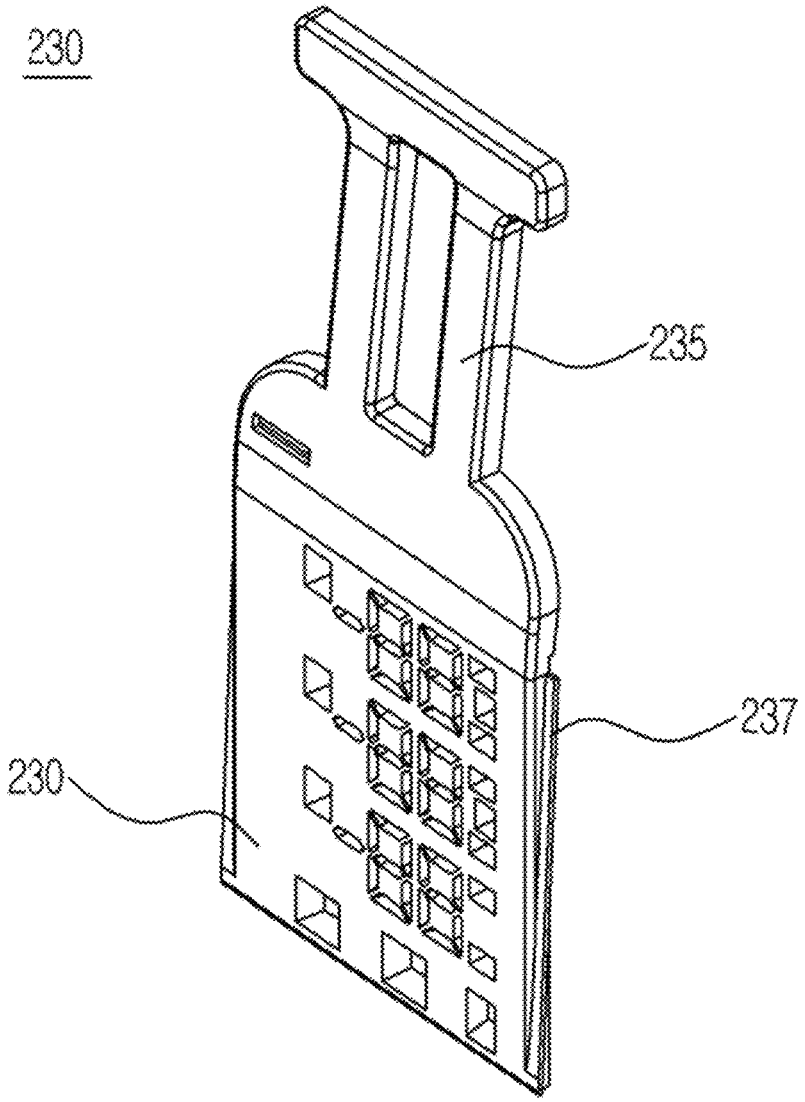
FIG. 11 is a perspective view of a display unit of FIG. 9.
Figure 12:
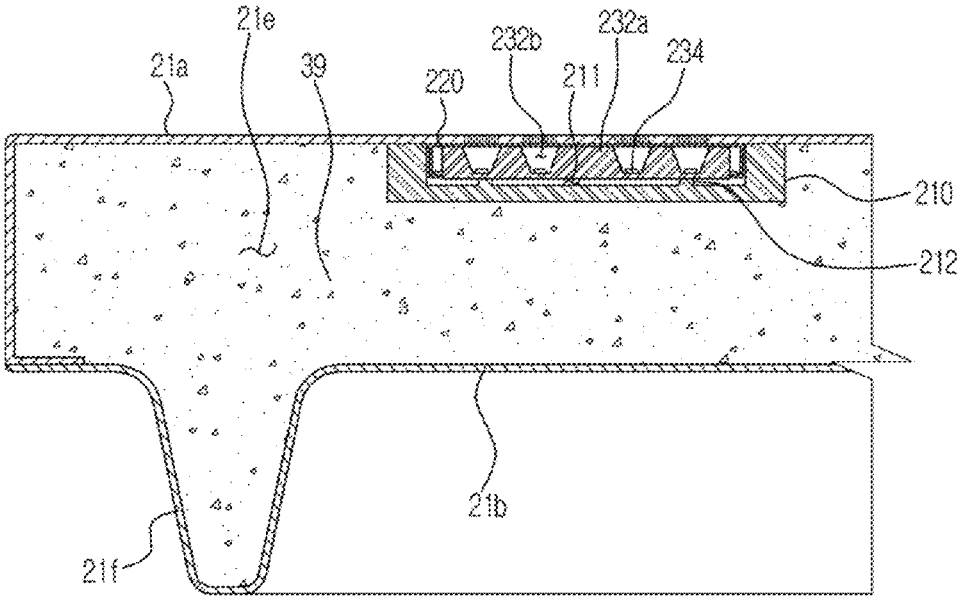
FIG. 12 is a cross-sectional view of the door of the refrigerator of FIG. 9.

FIG. 9 is a schematic exploded perspective view of a door and a display assembly of the refrigerator of FIG. 1, and FIG. 10 is a perspective view of a display housing of FIG. 9, and FIG. 11 is a perspective view of a display unit of FIG. 9, and FIG. 12 is a cross-sectional view of the door of the refrigerator of FIG. 9.

Referring to FIGS. 9, 10, 11 and 12, the door 21 may be formed by coupling a front plate 21*a* that constitutes a front side and both sides of the door 21, a rear plate 21*b* that is coupled to a rear side of the front plate 21*a* and constitutes a rear side of the door 21, and an upper cap 21*c* and a lower cap 21*d* that seal top and bottom ends of an internal space formed between the front plate 21*a* and the rear plate 21*b* to one another.

The front plate 21*a* may be formed of a metal material, such as steel, aluminum, alloy, periodic cellular metal (PCM), or vinyl chloride monomer (VCM). The front plate 21*a* may be formed by bending one plate so as to constitute the front side and both sides of the door 21.

The front plate 21*a* has higher strength than that of a tempered glass plate or a resin plate due to characteristics of the metal material and may give a luxurious feeling. An esthetic appealing of the front plate 21*a* may be further improved through surface treatment of metal.

That is, a hair line process, a mirror polishing process, or a bead blast process may be performed on the surface of the front plate 21*a*. In an embodiment, one among these processes may be performed on the front plate 21*a*.

Alternatively, the plurality of processes may be performed on the front plate 21*a*. That is, the front plate 21*a* may have all of hair line patterns, gloss, and beads. In this case, a process order may be the order of the mirror polishing process, the hair line process, and the bead blast process.

The rear plate 21*b* may be vacuum-formed of a resin material. The rear plate 21*b* may have a dike 21*f* that protrudes rearwards so that a door guard may be mounted on the rear plate 21*b*.

Each of the upper cap 21*c* and the lower cap 21*d* may be injection-molded using a resin material. After the front plate 21*a*, the rear plate 21*b*, the upper cap 21*c*, and the lower cap 21*d* are coupled to one another, an insulating material foaming solution may be injected and foamed into the internal space.

That is, a foaming space 21*e* in which an insulating material 39 is foamed, is formed between the front plate 21*a* and the rear plate 21*b*. The insulating material 39 is used to insulate a refrigerator compartment 20, and urethane may be used as the insulating material 39. If foaming of the insulating material foaming solution is completed in the foaming space 21*e*, the front plate 21*a*, the rear plate 21*b*, the upper cap 21*c*, and the lower cap 21*d* may be solidly coupled to one another using an adhesive force of the foaming solution.

A display assembly 200 is provided to an inside of the door 21 (FIG. 1). The display assembly 200 may display operating information of the refrigerator 1 or may receive operating instructions of the refrigerator 1.

Figure 17:
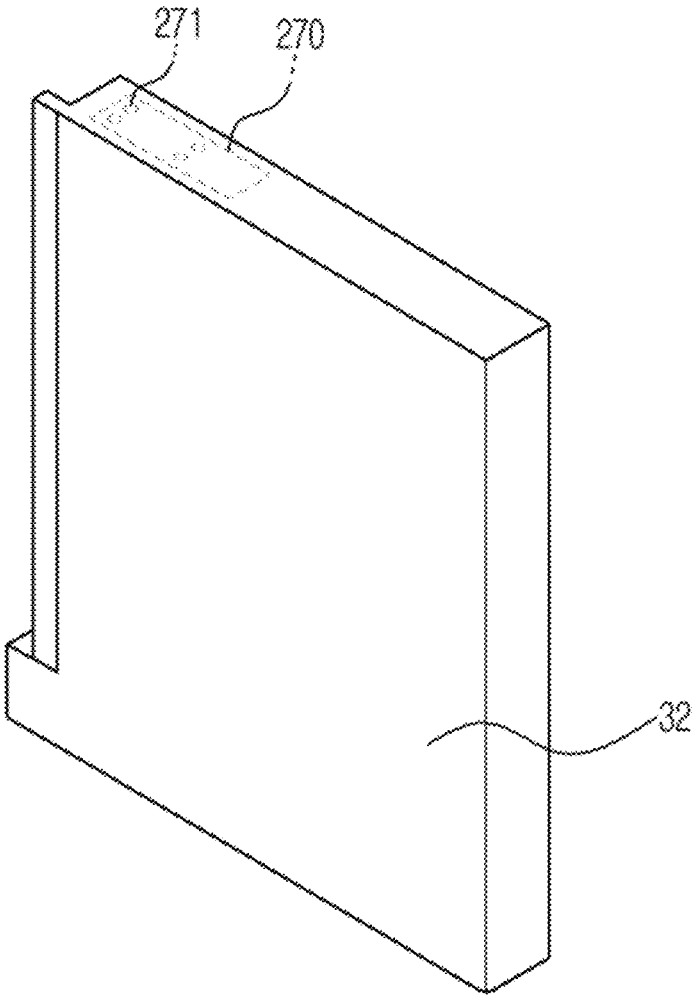
FIG. 17 is a view of an input member of a display assembly of FIG. 9.

According to an embodiment of the present invention, the display assembly 200 may include a display housing 210 (FIG. 9), a display guide portion 220 (FIG. 10), a display unit 230 (FIG. 9), and an input member 270 (FIG. 17).

The display housing 210 has opened front and top surfaces. The display housing 210 may be fixed to an upper portion of a rear surface of the front plate 21*a* inside the door 21.

The display housing 210 includes an accommodation space 211. The accommodation space 211 may be formed in the form of a groove in front of the display housing 210. The accommodation space 211 may provide a space in which the display guide portion 220 and the display unit 230 are accommodated.

Fixing protrusions 212 may be provided in the accommodation space 211 so as to fix the display unit 230 by pressurizing the display unit 230 in a forward direction. The fixing protrusions 212 may be placed at a rear side of the display housing 210. The fixing protrusions 212 may protrude forwards from the display housing 210. The fixing protrusions 212 may have an approximately gentle curved surface so as to guide movement of the display unit 230 inserted from upwards to downwards. The fixing protrusions 212 may also be provided as an elastic member having elasticity.

The display guide portion 220 may be installed in the display housing 210. The display guide portion 220 may include a guide portion front plate 221, a guide portion side plate 222, and a guide support portion 223. The display guide portion 220 may guide the display unit 230 that will be described later, to be in close contact with the rear surface of the front plate 21*a*.

The guide portion front plate 221 may be provided in the same form as that of the front side of the display unit 230. The guide portion side plate 222 may be provided to extend from both sides of the guide portion front plate 221 rearwards. The guide support portion 223 may be provided to be bent inwards from one end of the guide portion side plate 222.

According to an embodiment, the guide portion side plate 222 may be provided so that a length that extends from the guide portion front plate 221 may be decreased as being closer to a lower portion of the guide portion side plate 222. When viewed from a lateral direction, the guide portion side plate 222 may be provided in the form of a diagonal line.

The display unit 230 may include display guide members 237 disposed at sides of the display unit 230. Each of the display guide members 237 may be provided to extend from both sides of the display unit 230. According to an example, one end of each display guide member 237 may be placed in front of a bottom end of both sides of the display unit 230, and the other end of each display guide member 237 may be placed in rear of a top end of both sides of the display unit 230. Each display guide member 237 may be provided in a diagonal line to extend from the front of a bottom end of sides of the display unit 230 to a direction of a rear side of an upper side of the display unit 230.

When the foaming solution for the insulating material 39 is injected and foamed in the foaming space 21*e*, the foaming solution of the insulating material 39 should not to permeate into the accommodation space 211. Thus, to this end, the upper cap 21*c* may be disposed so that the front side of the display housing 210 may be in close contact with the rear surface of the front plate 21*a*.

The display housing 210 is in close contact with the rear surface of the front plate 21*a* so that the accommodation space 211 formed in the display housing 210 may be separated from and partitioned off from the foaming space 21*e*. That is, upper, lower, right, and left sides and a rear side of the accommodation space 211 may be covered by the display housing 210, and a front side of the accommodation space 211 may be covered by the rear surface of the front plate 21*a*.

Although not shown, a sealing member may be disposed at a front side of the display housing 210 so as to guarantee sealing of the accommodation space 211 and the foaming space 21*e*. The sealing member may be formed an elastic material, such as rubber, or a material having an adhesive property, such as a tape.

The upper cap 21*c* may further include a cover 214 that seals an upper cap insertion hole 213 after the upper cap 21*c* is inserted into the accommodation space 211 of the display assembly 200 through the upper cap insertion hole 213.

Through this structure, the display assembly 200 may be mounted in the door 21 and is not exposed to the outside. However, if particular information is displayed on the display assembly 200, the information may be displayed to the outside through a plurality of through holes 229 of the front plate 21*a*.

Figure 13:
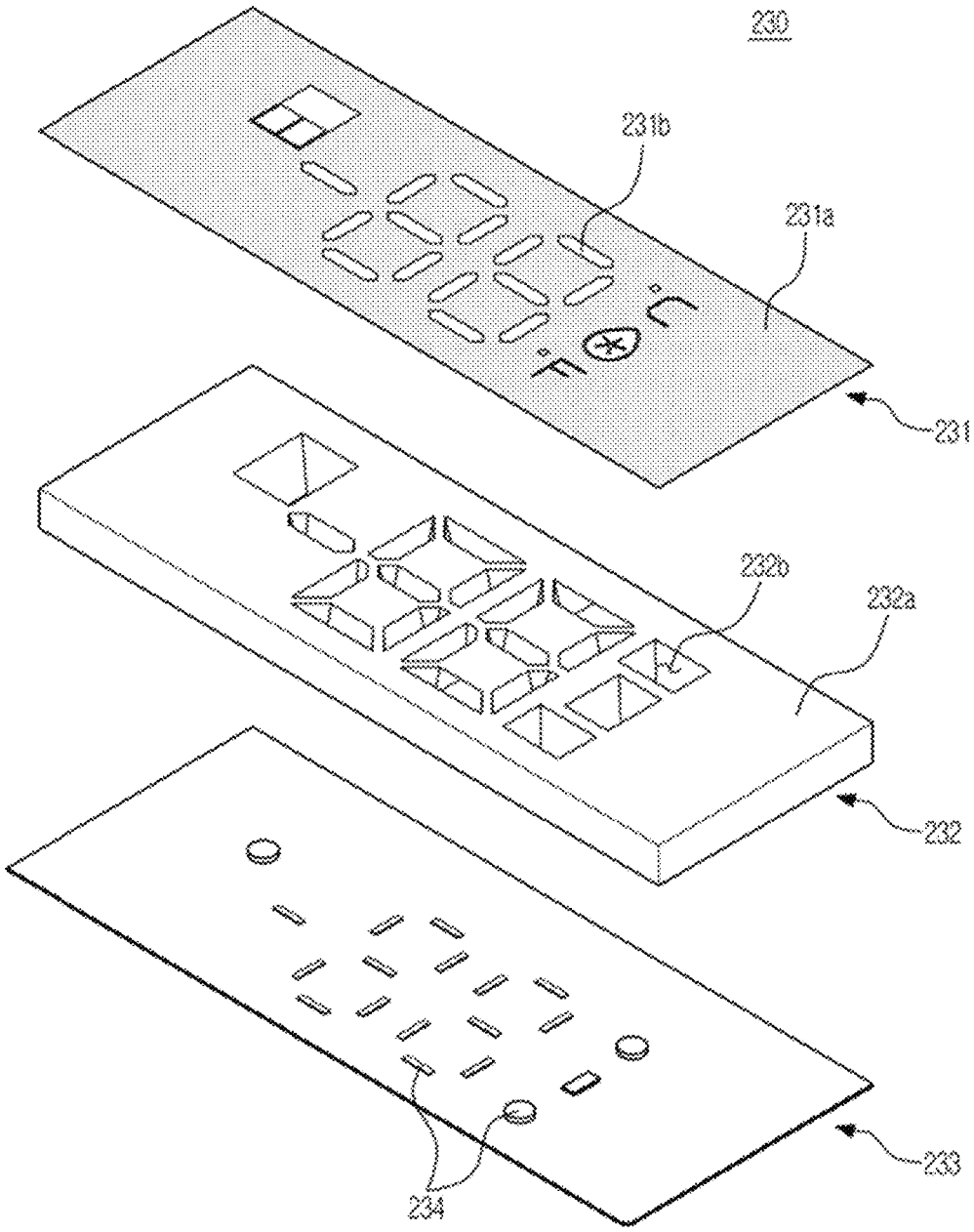
FIG. 13 is an exploded view of the display unit of the refrigerator of FIG. 9.

FIG. 13 is an exploded view of the display unit of the refrigerator of FIG. 9.

Referring to FIG. 13, the display unit 230 may include a cover sheet 231, a light source portion 233 that emits light, and a guide portion 232 that guides light emitted from the light source portion 233 toward a display portion 231*b*.

The cover sheet 231 may include the display portion 231*b* that displays operating information of the refrigerator 1 by being brightened or darkened and a blocking portion 231*a* that is maintained in a relatively dark state. The display portion 231*b* may be formed of a transparent material or a fluorescent material, and the blocking portion 231*a* may be formed of an opaque material.

The cover sheet 231 may be provided separately from the guide portion 232 and may be adhered to one surface of the guide portion 232.

The display portion 231*b* may be configured as one among a picture, a character, a number, a symbol for displaying the operating information of the refrigerator 1, a segment that constitutes part thereof, or a combination thereof. Thus, when light is radiated onto the cover sheet 231, the picture, the character, the number, and the symbol of the display portion 231*b* may be brightened, and the operating information of the refrigerator 1 may be displayed.

The light source portion 233 may include a light emitting diode (LED) 234 that emits light. A plurality of LEDs 234 may be provided and independently controlled.

The guide portion 232 guides light emitted from the LED 234 toward the cover sheet 231. The guide portion 232 includes a guide body portion 232*a* formed of a material that reflects light, and a guide hole 232*b* formed through the guide body portion 232*a*. The guide hole 232*b* may be formed so that the size of the guide hole 232*b* may be gradually increased from the LED 234 toward the cover sheet 231, as illustrated in FIG. 12.

Figure 14:
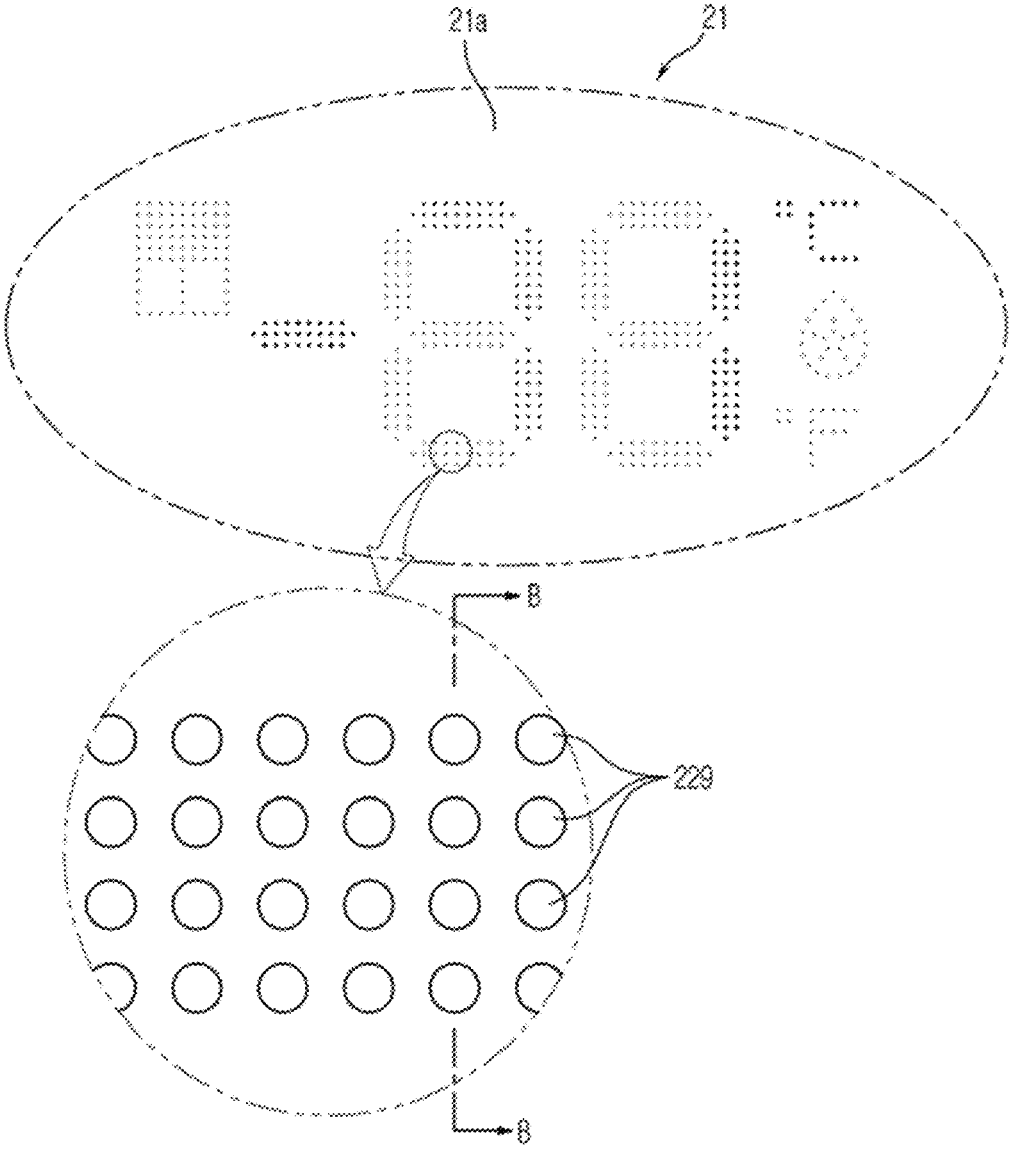
FIG. 14 is an enlarged view of a perimeter of through holes of a front plate of the refrigerator of FIG. 9.
Figure 15:
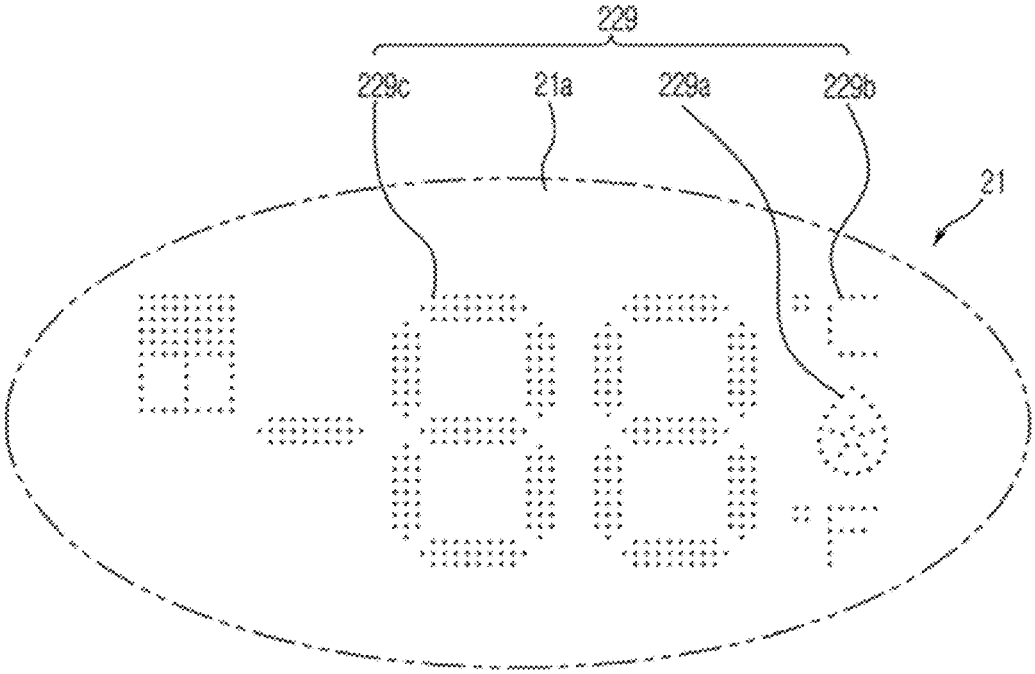
FIG. 15 is an enlarged view of a perimeter of through holes of the front plate in a state in which the display unit of the refrigerator of FIG. 9 is turned off.
Figure 16:
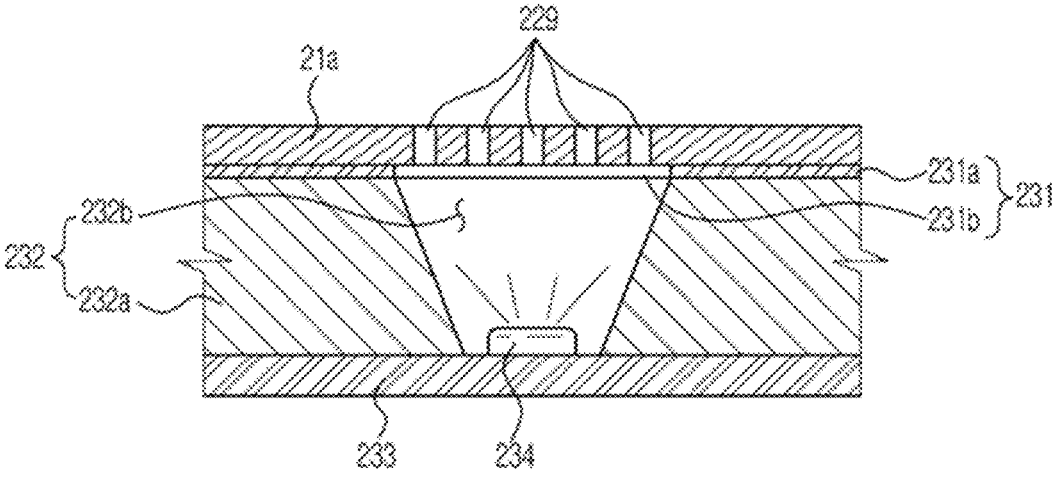
FIG. 16 is a cross-sectional view taken along line B-B' of FIG. 14.

FIG. 14 is an enlarged view of a perimeter of through holes of a front plate of the refrigerator of FIG. 9, and FIG. 15 is an enlarged view of a perimeter of through holes of the front plate in a state in which the display unit of the refrigerator of FIG. 9 is turned off, and FIG. 16 is a cross-sectional view taken along line B-B' of FIG. 14.

Referring to FIGS. 14, 15 and 16, when the display assembly 200 hidden in the door 21 displays particular information, the information may be displayed through a plurality of through holes 229 of the front plate 21*a* of the door 21, as illustrated in FIG. 14.

The plurality of through holes 229 formed in the front plate 21*a* may have a diameter of about 0.1 to 0.5 mm, and a distance between the through holes 229 may be about 0.3 to 1.5 mm. The through holes 229 may be observed with approximately a user's naked eye. In this case, it is assumed that a thickness of the front plate 21*a* is 0.6 mm or less.

The through holes 229 may be formed by performing an etching process or a laser drilling process. When the size of the through holes 229 is in the range of 0.3 to 0.4 mm, etching with high precision may be appropriate for the through holes 229.

When the size of the through holes 229 is 0.2 mm or less, slight thermal deformation or burr may occur. However, the through holes 229 may be formed using the laser drilling process. Discrimination of a shape having a relatively small size is lowered when the size of the through holes 229 is large. Thus, the size of the through holes 229 may be 0.2 mm or less.

That is, the through holes 229 may be arranged to form a shape of a picture 229*a*, a character 229*b*, and a segment 229*c* of a number that correspond to a picture, a character, and a segment of a number of the display portion 231*b*. Thus, when the LED is turned on and a particular picture, a particular character, a particular number, and a particular symbol are displayed on the display assembly 200, the particular picture, the particular character, the particular number, and the particular symbol may be displayed on the front plate 21*a* of the door 21.

FIG. 17 is a view of an input member of a display assembly of FIG. 9.

Referring to FIG. 17, the display unit in accordance with an embodiment of the present invention may be placed so that the input member 270 is separated from the display unit 230. The display unit 230 may be provided in a position of the door 21 in which the user easily watches the display unit 230. As described above, the display unit 230 may be placed at an upper portion of an inside of the upper door 21.

According to an example, the input member 270 may be placed at a different door from the door 21 in which the display unit 230 is placed. The input member 270 may be placed at an inside of an upper cap 32*a* of a lower door 32.

The input member 270 may receive the operating instructions of the refrigerator 1. The input member 270 may be provided in a capacitive touch sensing manner.

For example, the input member 270 may have a sensor (not shown) that measures a change in charges caused by the user's touch.

When the user touches a particular region corresponding to the position of a touch button 271, the sensor may sense whether the user touches the particular region, by measuring a change in charges that flow through the touch button 271. Of course, the input member 270 may adopt various well-known methods, such as a capacitive method, a resistive method, a dome switch method, and an infrared (IR) proximity sensing method.

In this case, forming the through holes 229 in the front plate 21*a* of the door 21 and disposing and hiding the display unit 230 in the door 21 may be applied to not only a refrigerator but also a kitchen electronic appliance, such as a cooking device.

Figure 18:
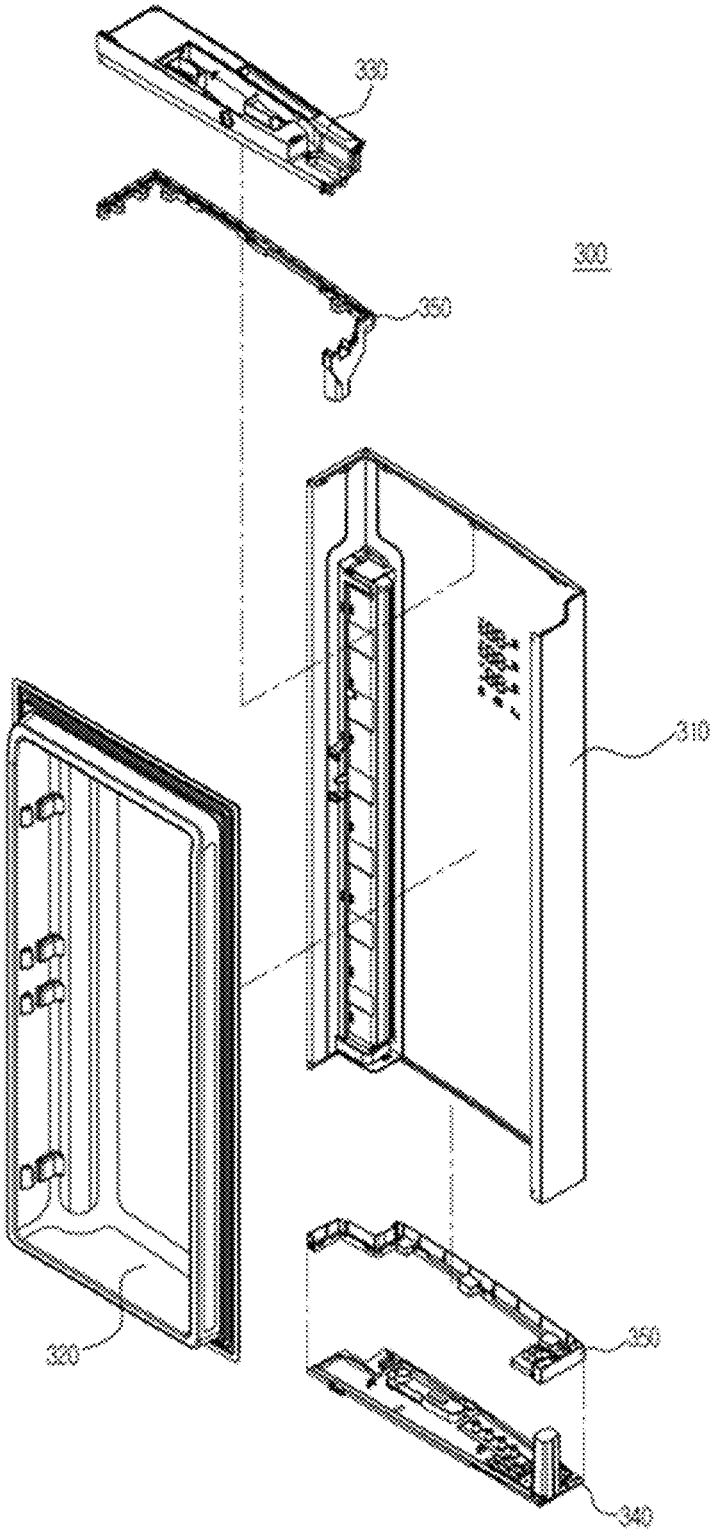
FIG. 18 is a schematic exploded perspective view of the door of the refrigerator of FIG. 1.
Figure 19:
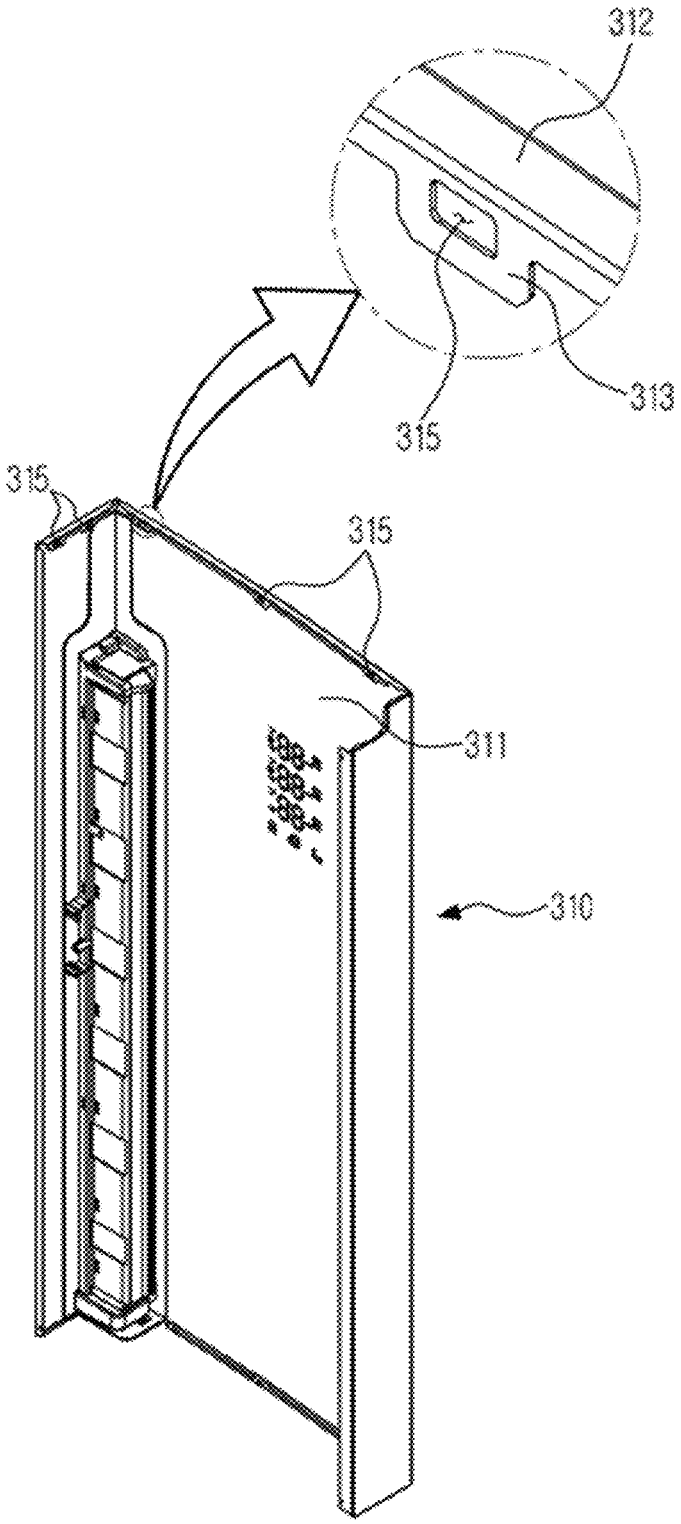
FIG. 19 is an enlarged view of connection member coupling holes of the front plate of the door of FIG. 18.

FIG. 18 is a schematic exploded perspective view of the door of the refrigerator of FIG. 1, and FIG. 19 is an enlarged view of connection member coupling holes of the front plate of the door of FIG. 18.

Referring to FIGS. 18 and 19, a door 300 in accordance with an embodiment of the present invention may include a front plate 310, a rear plate 320, an upper cap 330, a lower cap 340, and a connection member 350.

The front plate 310 constitutes a front side and both sides of the door 300. The front plate 310 may be formed of a metal material, such as steel, aluminum, alloy, PCM, or VCM. The front plate 310 may be formed by bending one plate so as to form the front side and both sides of the door 300.

The front plate 310 may include a first front plate coupling portion 312 that is bent from a top end in a direction of an inside of the door 300 and a second front plate coupling portion 313 that extends from the first front plate coupling portion 312 in a vertical downward direction. The first front plate coupling portion 312 and the second front plate coupling portion 313 may be formed by bending one plate.

According to an example, the front plate 310 may include a connection member coupling hole 315. The connection member coupling hole 315 may be installed in the second front plate coupling portion 313. A plurality of second front plate coupling portions 313 may be provided. A plurality of connection member coupling holes 315 may be provided in the second front plate coupling portion 313 at regular intervals.

Referring back to FIG. 18, the rear plate 320 is coupled to a rear surface of the front plate 310 and constitutes a rear side of the door 300. The rear plate 320 may be vacuum-formed using a resin material. The rear plate 320 may have a dike (not shown) that protrudes rearwards so that a door guard may be mounted on the rear plate 320.

The upper cap 330 and the lower cap 340 seal a top end and a bottom end of the internal space formed between the front plate 310 and the rear plate 320. The upper cap 330 and the lower cap 340 may be injection-molded using a resin material. According to an embodiment of the present invention, the upper cap 330 and the lower cap 340 may be coupled to the connection member 350 and may seal the top end and the bottom end of the internal space formed between the front plate 310 and the rear plate 320.

Hereinafter, the upper cap 330 that seals the top end of the door 300 and the connection member 350 will be described in detail.

Figure 20:
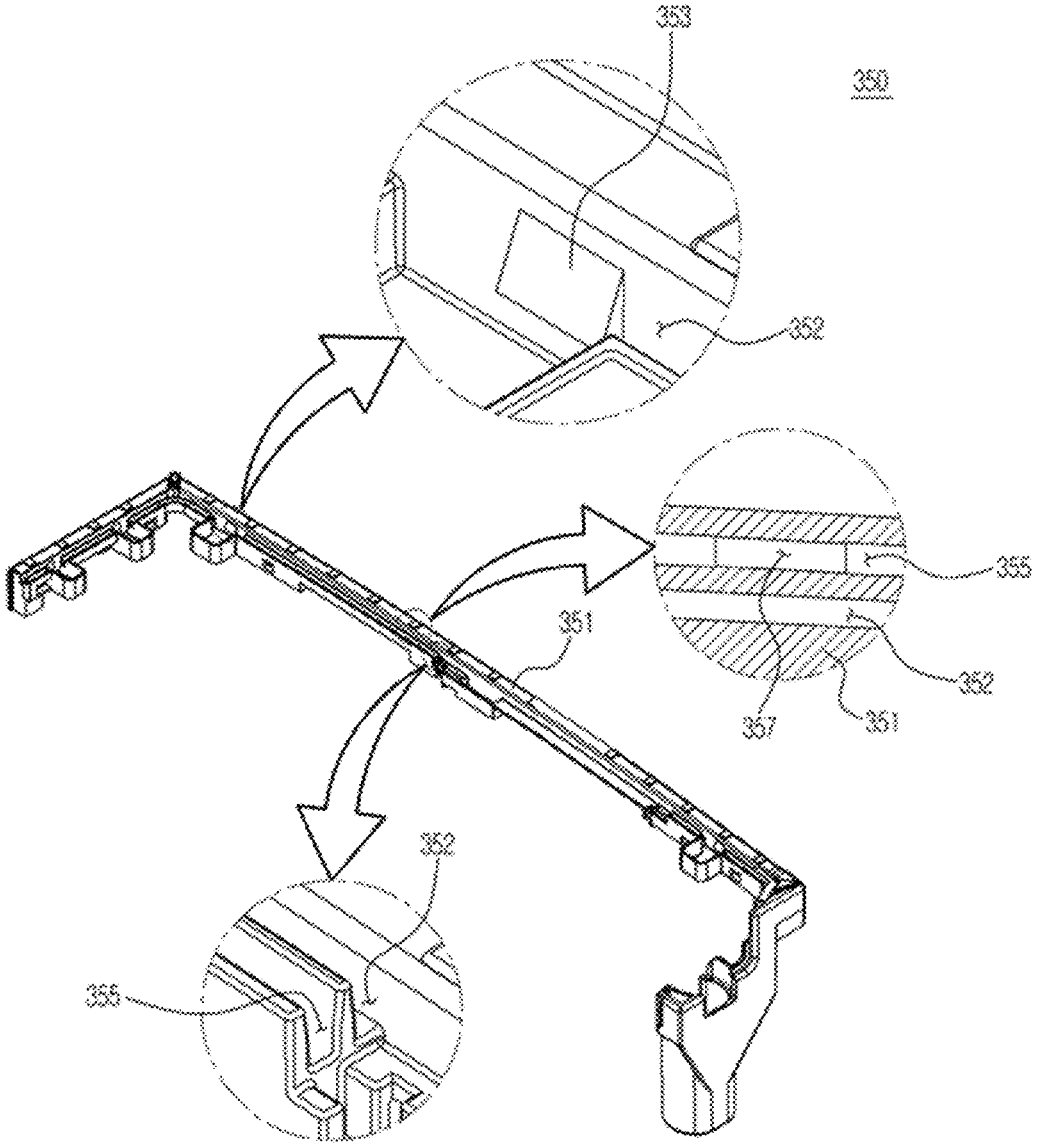
FIG. 20 is an enlarged view of a connection member of FIG. 18.

FIG. 20 is an enlarged view of a connection member of FIG. 18.

Referring to FIG. 20, the connection member 350 may include a first connection member groove 352, a second connection member groove 355, a front plate hanging portion 353, and an upper cap coupling hole 357. The connection member 350 may be configured to be fixed to a top end of an inside of the front plate 310.

The first connection member groove 352 is formed along an outer circumference of a top surface of the connection member 350. The first connection member groove 352 is installed in a position in which the second front plate coupling portion 313 of the front plate 310 may be inserted. The first connection member groove 352 may be placed at an inside of the first front plate coupling portion 312 to the width of the first front plate coupling portion 312 from edges of the connection member 350 at a top surface of the connection member 350.

The first connection member groove 352 has the front plate hanging portion 353 formed in an inside of the first connection member groove 352. According to an example, the front plate hanging portion 353 may be provided with the same number as that of the connection member coupling holes 315. The front plate hanging portion 353 may be provided in a position in which the front plate hanging portion 353 overlaps the connection member coupling hole 315 when the connection member 350 is fixed to the top end of the inside of the front plate 310. The connection member 350 may be coupled to the front plate 310 when the connection member coupling hole 315 is hung in a bottom end of the front plate hanging portion 353.

According to an example, the front plate hanging portion 353 may be provided so that a thickness at which the front plate hanging portion 353 protrudes, may be decreased as being closer to an upper portion of the front plate hanging portion 353. Thus, the connection member coupling hole 315 may be provided to be easily coupled to the front plate hanging portion 353 when the connection member coupling hole 315 is moved from upwards to downwards.

The second connection member groove 355 is installed at the top surface of the connection member 350. The second connection member groove 355 may be placed at the inside of the first connection member groove 352 at regular intervals with the first connection member groove 352.

According to an example, the upper cap coupling hole 357 may be installed in an inside of the second connection member groove 355. The upper cap coupling hole 357 may be installed in a bottom surface of the second connection member groove 355. A plurality of upper cap coupling holes 357 may be provided in the inside of the second connection member groove 355 at regular intervals. The upper cap 330 may be coupled to the inside of the second connection member groove 355.

Figure 21:
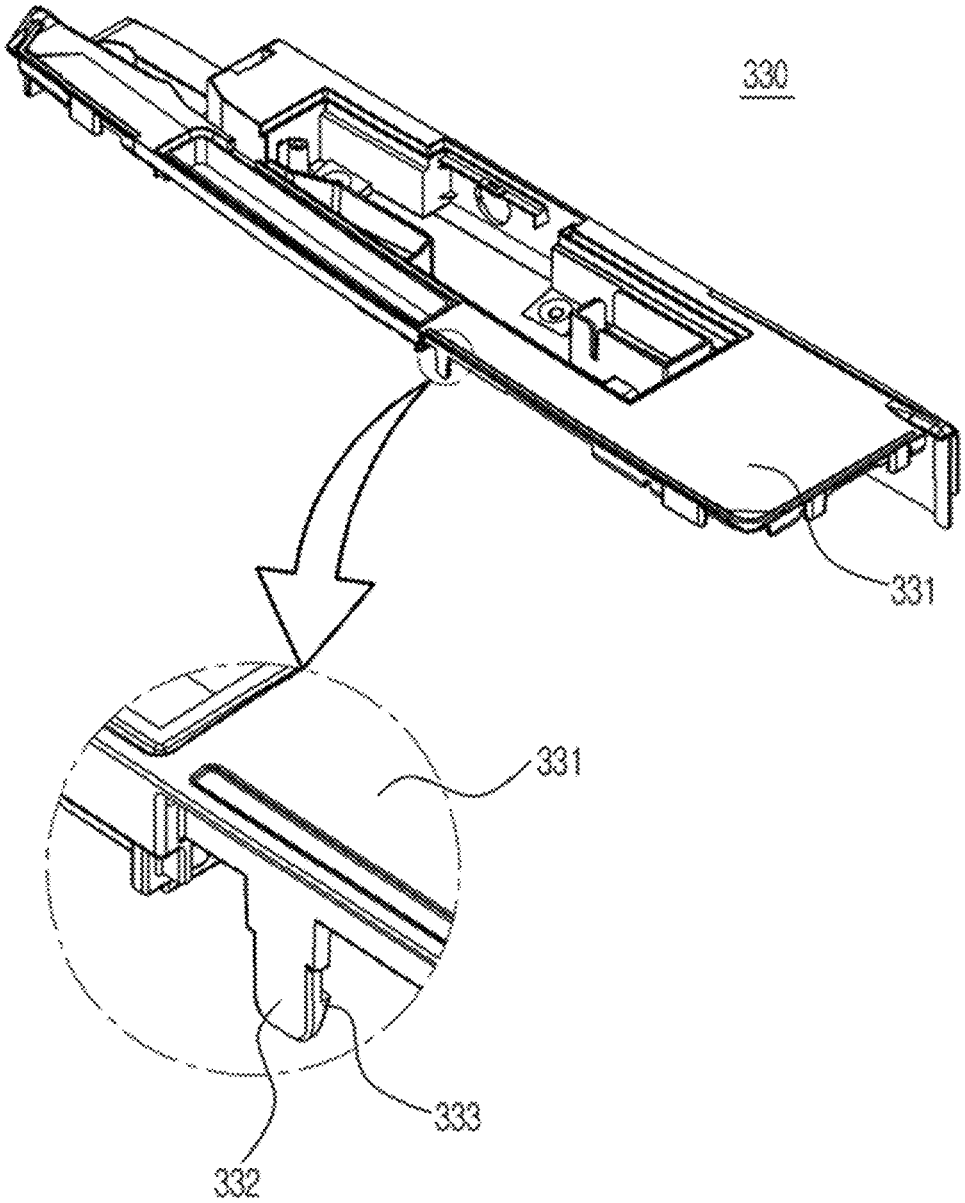
FIG. 21 is a view of an upper cap of FIG. 18 and a connection member coupling portion of the upper cap.

FIG. 21 is a view of an upper cap of FIG. 18 and a connection member coupling portion of the upper cap.

Referring to FIG. 21, the upper cap 330 may include a connection member coupling portion 332 inserted into the second connection member groove 355. The connection member coupling portion 332 may be provided to extend downwards from a front side and sides of the upper cap 330 placed to face the front plate 310. The connection member coupling portion 332 may be provided to extend from the upper cap 330 to the same length as the depth of the second connection member groove 355.

According to an example, the connection member coupling portion 332 may have a connection member hanging portion 333. According to an example, a plurality of connection member hanging portions 333 may be provided with the same number as that of the upper cap coupling holes 357.

According to an example, the connection member hanging portion 333 may be provided so that a thickness at which the connection member hanging portion 333 protrudes, may be increased as being closer to an upper portion of the connection member hanging portion 333. Thus, the connection member hanging portion 333 may have a shape in which the connection member hanging portion 333 may be easily fixed and coupled to the upper cap coupling hole 357 of the connection member 350 when the connection member hanging portion 333 is moved downwards.

The connection member hanging portion 333 may be provided in a position in which the connection member hanging portion 333 overlaps the upper cap coupling hole 357 when the upper cap 330 closes a top surface of the door 300. The upper cap 330 is coupled to the connection member 350 when the upper cap coupling hole 357 is hung in the top end of the connection member hanging portion 333. The upper cap 330 may be coupled to the connection member 350 and may seal the top end of the door 300.

Hereinafter, an operation in which the upper cap 330 is installed to seal the top end of the door 300, in accordance with an embodiment of the present invention will be described.

Figure 22:
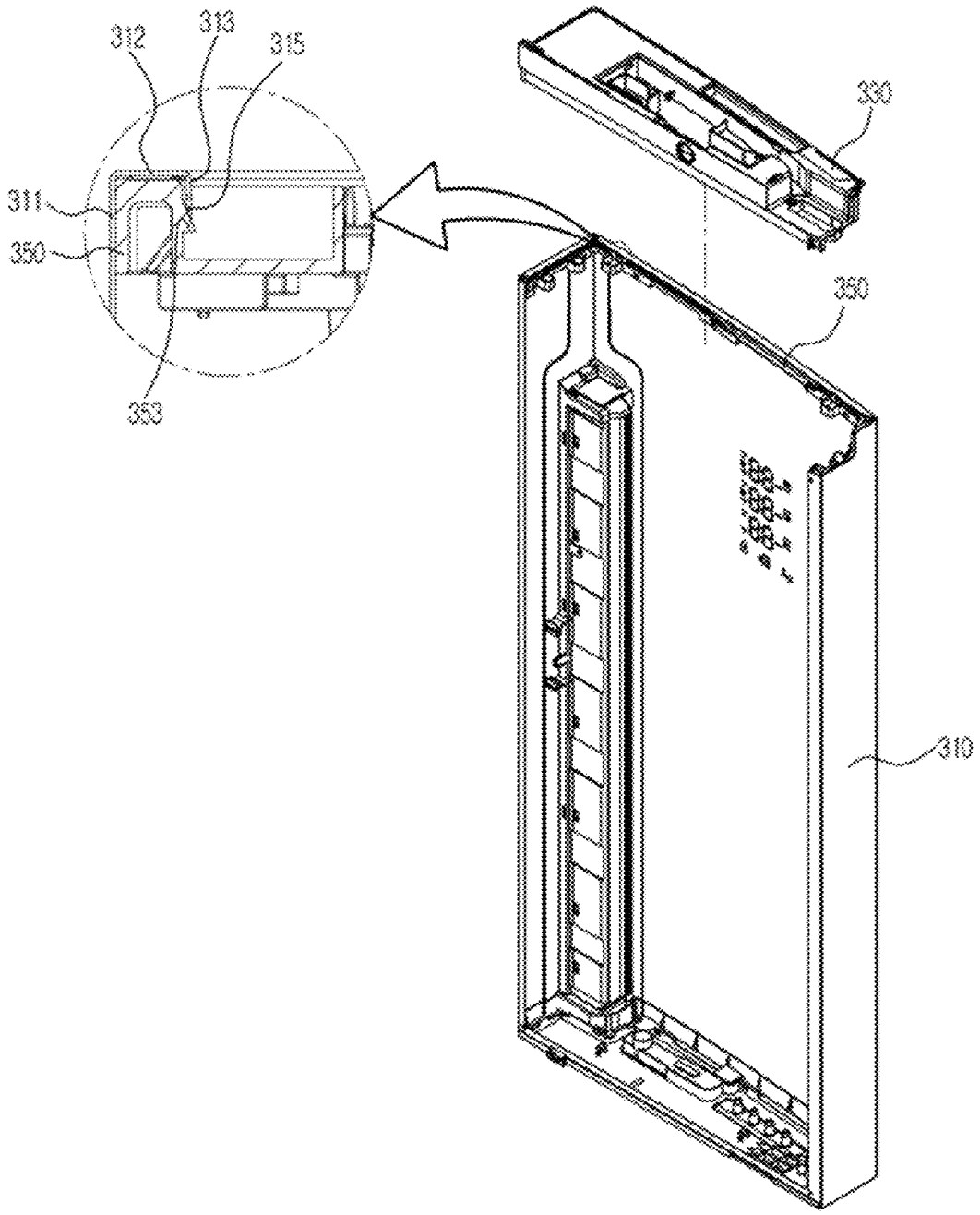
FIG. 22 is a view of an operation of coupling the front plate and the connection member of FIG. 18 each other.
Figure 23:
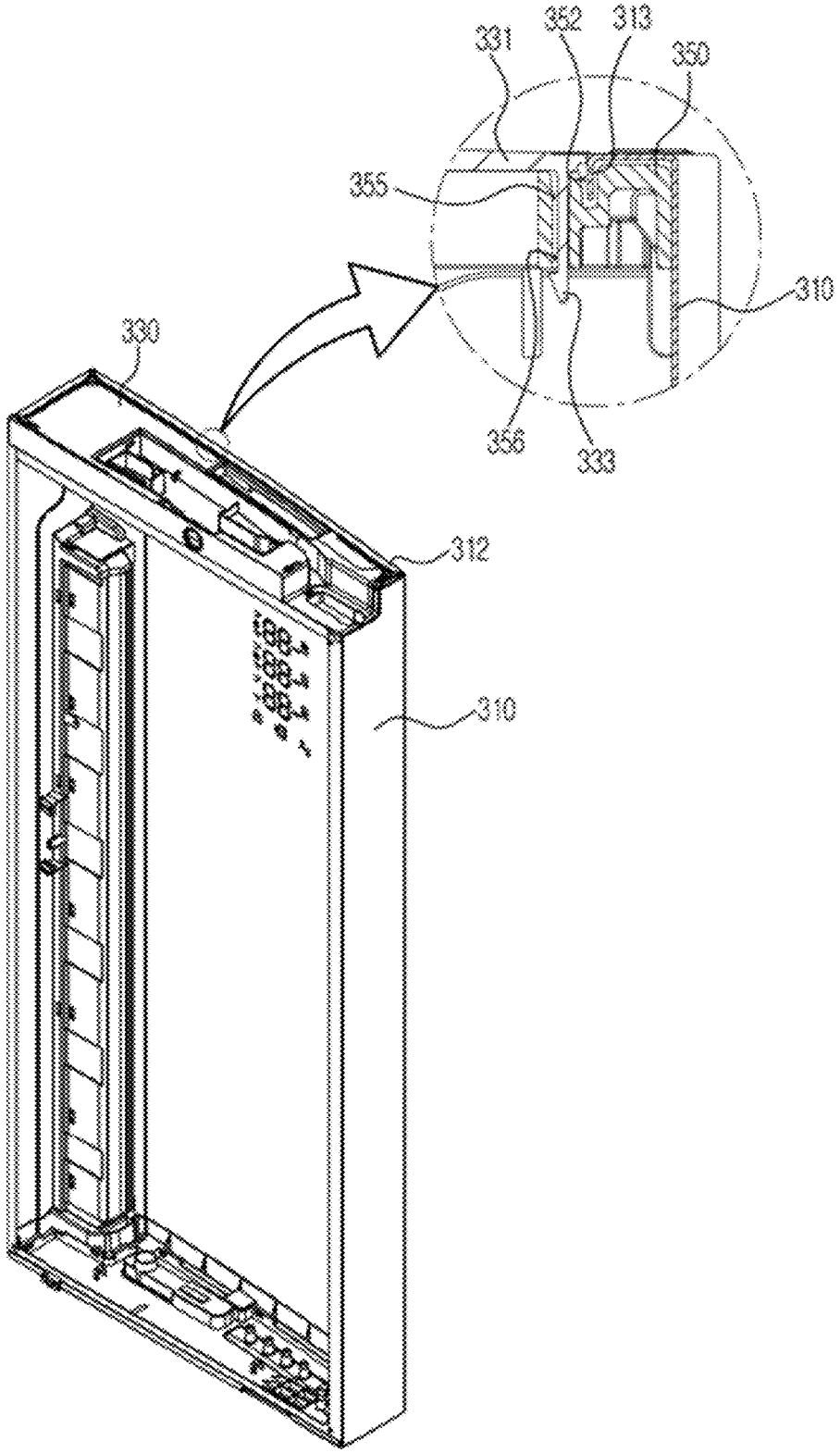
FIG. 23 is a view of an operation of coupling the upper cap and the connection member of FIG. 18 each other.

FIG. 22 is a view of an operation of coupling the front plate and the connection member of FIG. 18 each other, and FIG. 23 is a view of an operation of coupling the upper cap and the connection member of FIG. 18 each other.

Referring to FIG. 22, the connection member 350 is coupled to the front plate 310. The connection member 350 may be fixed to the top end of the inside of the front plate 310.

According to an example, the connection member 350 may be coupled to the front plate 310 when the front plate hanging portion 353 is hung in an inside of the connection member coupling hole 315 of the front plate 310. As described above, since the front plate hanging portion 353 is provided in a position in which it overlaps the connection member coupling hole 315, when the connection member 350 is moved from a lower side to an upper side of the front plate 310, the front plate hanging portion 353 may be provided to be hung in the inside of the connection member coupling hole 315 of the front plate 310. In this case, part of the second front plate coupling portion 313 of the front plate 310 may be inserted into the inside of the first connection member groove 352 of the connection member 350. In detail, when the second front plate coupling portion 313 of the front plate 310 is inserted into the first connection member groove 352 and the front plate hanging portion 353 is coupled to the inside of the connection member coupling hole 315 of the front plate 310, the connection member 350 may be fixed and coupled to an upper portion of the inside of the front plate 310.

Referring to FIG. 23, the upper cap 330 is coupled to the connection member 350 fixed to the front plate 310.

According to an example, the upper cap 330 may be coupled to the connection member 350 when the connection member hanging portion 333 is hung in the inside of the upper cap coupling hole 357 of the connection member 350. As described above, since the connection member hanging portion 333 is provided in a position in which it overlaps the upper cap coupling hole 357, when the upper cap 330 is moved from an upper side to a lower side of the connection member 350, the connection member hanging portion 333 is hung in the inside of the upper cap coupling hole 357 of the connection member 350. In this case, the connection member coupling portion 332 of the upper cap 330 may be inserted into an inside of the second connection member groove 355 of the connection member 350. In detail, when the connection member coupling portion 332 is inserted into the second connection member groove 355 and the connection member hanging portion 333 is coupled to the inside of the upper cap coupling hole 357 of the connection member 350, the upper cap 330 may be fixed and coupled to the connection member 350.

As described above, in the door 300 in accordance with an embodiment of the present invention, the front plate 310 and the upper cap 330 are coupled to each other using the connection member 350 so that deformation, clearance, and heaving of the door 300 can be prevented from occurring, like in case where the front plate 310 and the upper cap 330 are assembled with each other in a shrink fit manner.

Also, an assembling proves of the door 300 may be effectively provided so that improvements in productivity and product reliability can be promoted.

The operation in which the front plate 310 and the upper cap 330 of the door 300 are coupled to each other using the connection member 350, has been described above. In the same way, the front plate 310 and the lower cap 340 of the door 300 may also be coupled to each other using the connection member 350. Also, all of the upper doors 21 and 22 and the lower doors 31 and 32 of the refrigerator 1 may be provided so that a front plate and an upper cap or a lower cap of each of the upper doors 21 and 22 and the lower doors 31 and 32 of the refrigerator 1 may be coupled to each other using the connection member 350, as described above.

Figure 24:
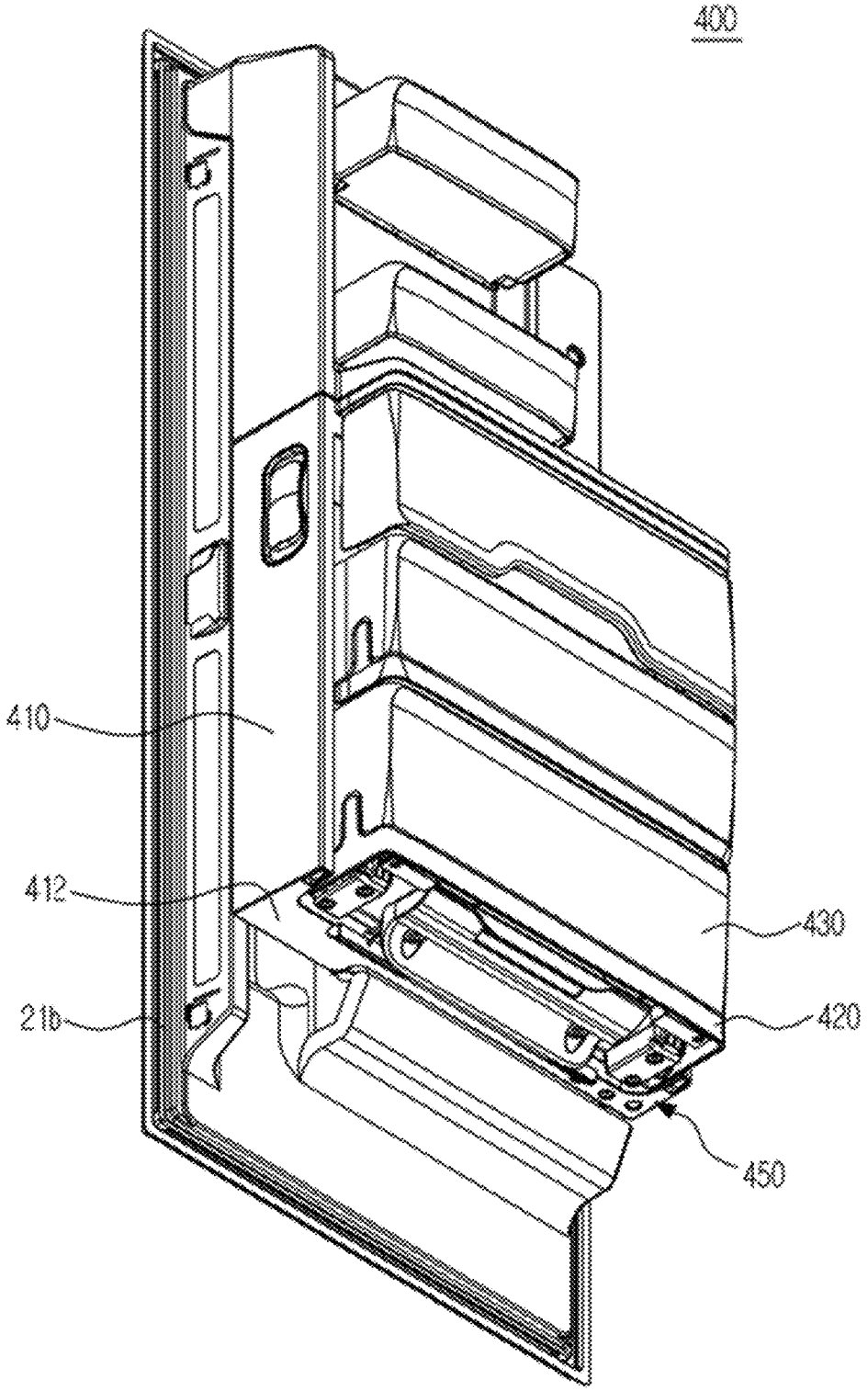
FIG. 24 is a perspective view of a tilting guard assembly installed at a rear side of the door of FIG. 2.
Figure 25:
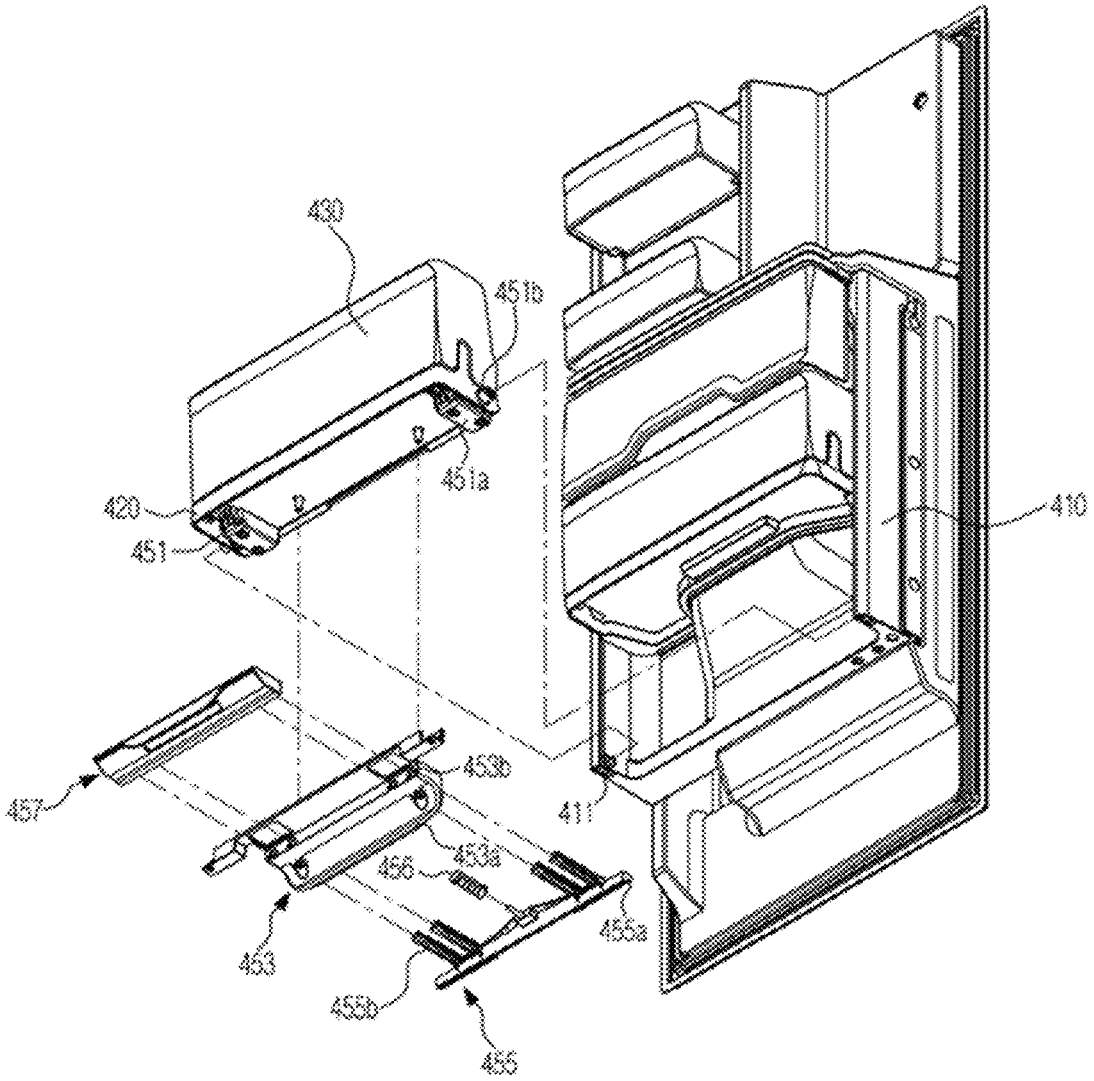
FIG. 25 is an exploded perspective view of a configuration of the tilting guard assembly of FIG. 24.

FIG. 24 is a perspective view of a tilting guard assembly installed at a rear side of the door of FIG. 2, and FIG. 25 is an exploded perspective view of a configuration of the tilting guard assembly of FIG. 24.

Referring to FIG. 24, a tilting guard assembly 400 includes a tilting body portion 410, a tray 420, a guard portion 430, and a tilting unit 450. The tilting guard assembly 400 is installed at a rear plate 21*b* of the door and is placed in a refrigerator compartment when the door is closed.

The tilting body portion 410 is coupled to the rear plate 21*b* of the door 21. The tilting body portion 410 is provided so that a rear side of the tilting body portion 410 may be in contact with the rear plate 21*b* of the door 21. The tilting body portion 410 is coupled to the tray 420 and the guard portion 430 and constitutes a storage space.

According to an example, the tilting body portion 410 includes fixed holes 411 formed in left and right sides of the tilting body portion 410. The fixed holes 411 in the left side of the tilting body portion 410 and the fixed holes 411 in the right side of the tilting body portion 410 are provided to the same height. A plurality of fixed holes 411 may be provided according to the number of trays 420 to be provided.

For example, when two or more trays 420 are provided to the tilting guard assembly 400, the fixed holes 411 may be provide to the left side and the right side of the tilting body portion 410 at a height at which each of the trays 420 is placed.

A tilting adjustment member 451 that will be described later may be inserted into the fixed holes 411. Thus, the tilting body portion 410 and the tray 420 may be coupled to each other.

The trays 420 may be provided in the form of a flat plate having a predetermined thickness. The trays 420 may constitute a storage space in a rear side of the door together with the tilting body portion 410. Food that is placed in the storage space of the rear side of the door is put on the trays 420. According to an example, a plurality of trays 420 may be provided.

Connection holes (not shown) may be formed in left and right sides of each of the trays 420. The connection holes in the left and right sides of each tray 420 may be provided in a position in which the connection holes overlap each other, when viewed from a lateral direction. Also, the connection holes may be formed in a position in which the connection holes overlap the fixed holes 411 of the tilting body portion 410, when viewed from the lateral direction in a state in which the tray 420 is coupled to the tilting body portion 410. According to an example, the connection holes may be placed in rear of sides of the trays 420.

The tilting adjustment member 451 that will be described later may be inserted into the connection holes. Thus, the tilting body portion 410 and the tray 420 may be coupled to each other.

The guard portion 430 constitutes a storage space together with the tray 420 and the tilting body portion 410. The guard portion 430 may include a front guard portion and a side guard portion formed to be bent from both ends of the front guard portion in a backward direction of the storage space. A bottom surface of the guard portion 430 may be provided to be fixed to a front end of a top surface and both sides of the tray 420.

The guard portion 430 may be formed of a transparent material so that food placed in the storage space can be seen from the outside.

Figure 26:
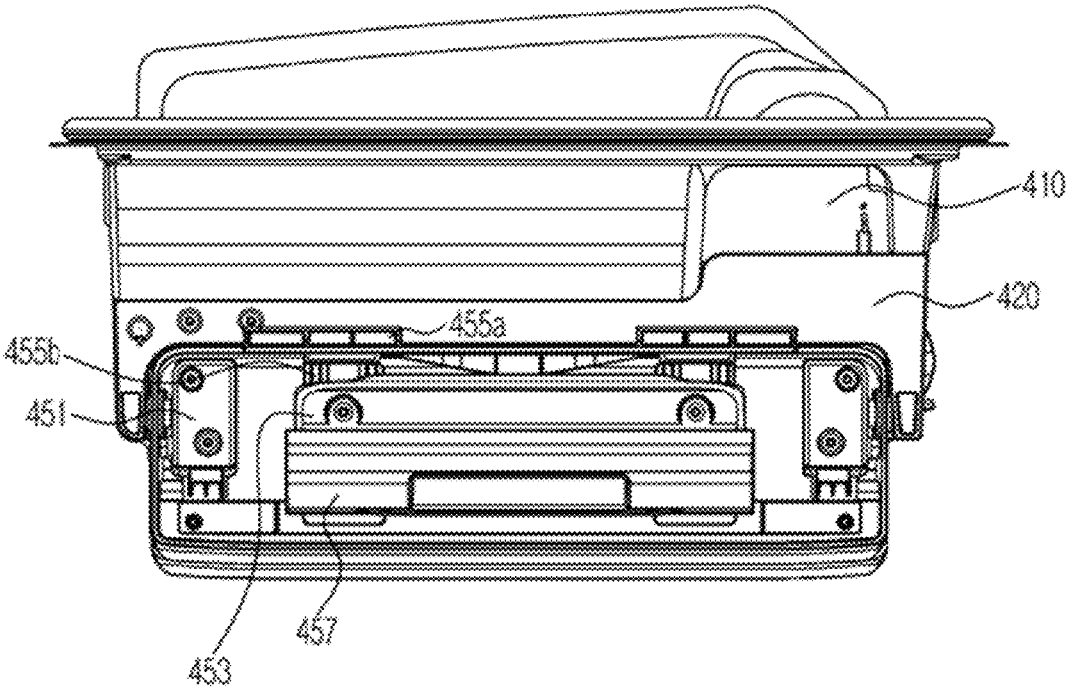
FIG. 26 is a bottom view of a tilting unit of a bottom surface of the tilting guard assembly of FIG. 24.
Figure 27:
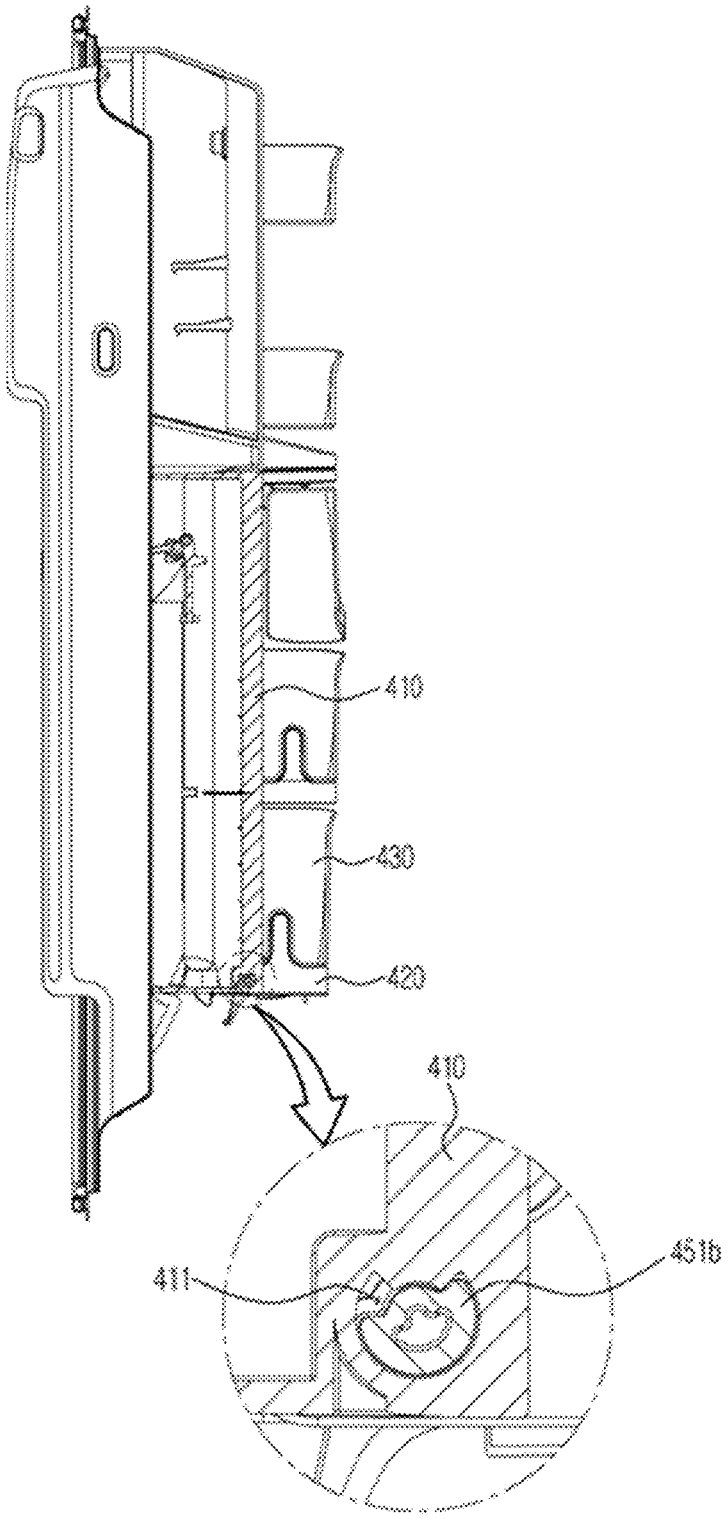
FIG. 27 is a cross-sectional view of a rotation adjustment member of the tilting unit of FIG. 25.

FIG. 26 is a bottom view of a tilting unit of a bottom surface of the tilting guard assembly of FIG. 24, and FIG. 27 is a cross-sectional view of the rotation adjustment member of the tilting unit of FIG. 25.

Referring to FIGS. 24, 25, 26 and 27, the tilting unit 450 may include the tilting adjustment member 451, a first tilting hanging member 453, a second tilting hanging member 455, and a handle member 457. The tilting unit 450 may cause the tray 420 and the guard portion 430 to be rotated at a predetermined angle in a state in which the tilting adjustment member 451 is used as an axis.

The tilting adjustment member 451 may include a support portion 451*a* and a rotation shaft 451*b*.

One side of the support portion 451*a* is coupled to the bottom surface of the tray 420. The support portion 451*a* may be rotated together with the tray 420 and may transfer a rotation force to the rotation shaft 451*b*.

The rotation shaft 451*b* may be installed on one end of the support portion 451*a*. One side of the rotation shaft 451*b* may be coupled to the tilting body portion 410, and the other side of the rotation shaft 451*b* may be coupled to the support portion 451*a*. The rotation shaft 451*b* may be provided to be rotated at the tilting body portion 410. The rotation shaft 451*b* may be rotated in a state in which it is inserted into the connection holes and the fixed holes 411.

According to an embodiment of the present invention, the rotation shaft 451*b* may have a hanging groove (not shown). The hanging groove may be provided to be concave in one side of an outer surface of the rotation shaft 451*b*.

According to an embodiment of the present invention, the fixed holes 411 have rotation adjustment grooves 411*a* that are inwardly concave. The fixed holes 411 cause the inserted rotation shaft 451*b* to be rotated within a predetermined range. In detail, the fixed holes 411 are provided so that one side of the hanging groove of the rotation shaft 451*b* that rotates at an inside of the fixed holes 411 may be hung in one side of the rotation adjustment groove 411*a*. In this way, the rotation shaft 451*b* may be inserted into the fixed holes 411 such that a rotation angle of the rotation shaft 451*b* may be limited.

The first tilting hanging member 453 has a first tilting hanging portion 453*a* and a tilting guide hole 453*b*. One side of the first tilting hanging member 453 is fixed to the bottom surface of the tray 420. The first tilting hanging portion 453*a* may be placed in rear of a bottom surface of the first tilting hanging member 453. The first tilting hanging portion 453*a* may be provided to extend from the rear of the first tilting hanging member 453 in a vertical downward direction. If the first tilting hanging portion 453*a* is rotated at a particular angle or more when the tilting guard assembly 400 is rotated, the first tilting hanging portion 453*a* is in contact with the bottom surface of the tilting body portion 410. Thus, the first tilting hanging member 453 may limit rotation of the tilting guard assembly 400.

The tilting guide hole 453*b* may be placed in one side of the first tilting hanging member 453. The tilting guide hole 453*b* may be provided so that a tilting guide portion 455*b* of the second tilting hanging member 455 that will be described later may be inserted into the tilting guide hole 453*b* and may be moved forwards or backwards.

The second tilting hanging member 455 includes a second tilting hanging portion 455*a* and the tilting guide portion 455*b*.

The second tilting hanging portion 455*a* may be placed at a rear side of the second tilting hanging member 455. The second tilting hanging portion 455*a* may protrude toward the rear of the second tilting hanging member 455. The second tilting hanging portion 455*a* may be placed to be in contact with the bottom surface of the tilting body portion 410. The second tilting hanging portion 455*a* may support the tilting guard assembly 400 not to be rotated in a state in which the second tilting hanging portion 455*a* supports the bottom surface of the tilting body portion 410.

The tilting guide portion 455*b* may be placed in front of the second tilting hanging member 455. The tilting guide portion 455*b* may be provided to extend from a front side of the second tilting hanging member 455 forwards. A plurality of tilting guide portions 455*b* may be provided. According to an example, the tilting guide portion 455*b* may be provided with the same number as that of the tilting guide holes 453*b*.

A restoration member 456 may be provided to part or all of the plurality of tilting guide portions 455*b*. The restoration member 456 may have a larger cross section than that of the tilting guide hole 453*b*. The restoration member 456 may guide the second tilting hanging member 455 to be moved backwards when the second tilting hanging member 455 is moved forwards by the user. The restoration member 456 may guide the second tilting hanging member 455 to be restored to a particular position. The restoration member 456 may include a spring.

According to an example, the second tilting hanging member 455 is provided to be moved along the tilting guide portion 455*b* of the first tilting hanging member 453. The second tilting hanging member 455 may be moved forwards or backwards independently from the bottom surface of the tray 420. The second tilting hanging member 455 may cause the tilting guide portion 455*b* to be moved into the tilting guide hole 453*b* of the fixed first tilting hanging member 453 forwards or backwards. Thus, the user may grasp the handle member 457 that will be described later and move the second tilting hanging member 455, thereby rotating the tilting guard assembly 400.

The handle member 457 may be provided to be coupled to the second tilting hanging member 455. The handle member 457 may be provided to be coupled to the front of the second tilting hanging member 455. According to an example, the handle member 457 may be provided to be coupled to the front of a bottom surface of the tilting guide portion 455*b*.

The handle member 457 may have a grasping groove 457*a* that is upwardly concave in a bottom surface of the handle member 457. The user may grasp the grasping groove 457*a* of the handle member 457 and move the second tilting hanging member 455 together with the handle member 457 forwards or backwards.

Hereinafter, an operation in which the tilting guard assembly is rotated, in accordance with an embodiment of the present invention will be described.

Figure 28:
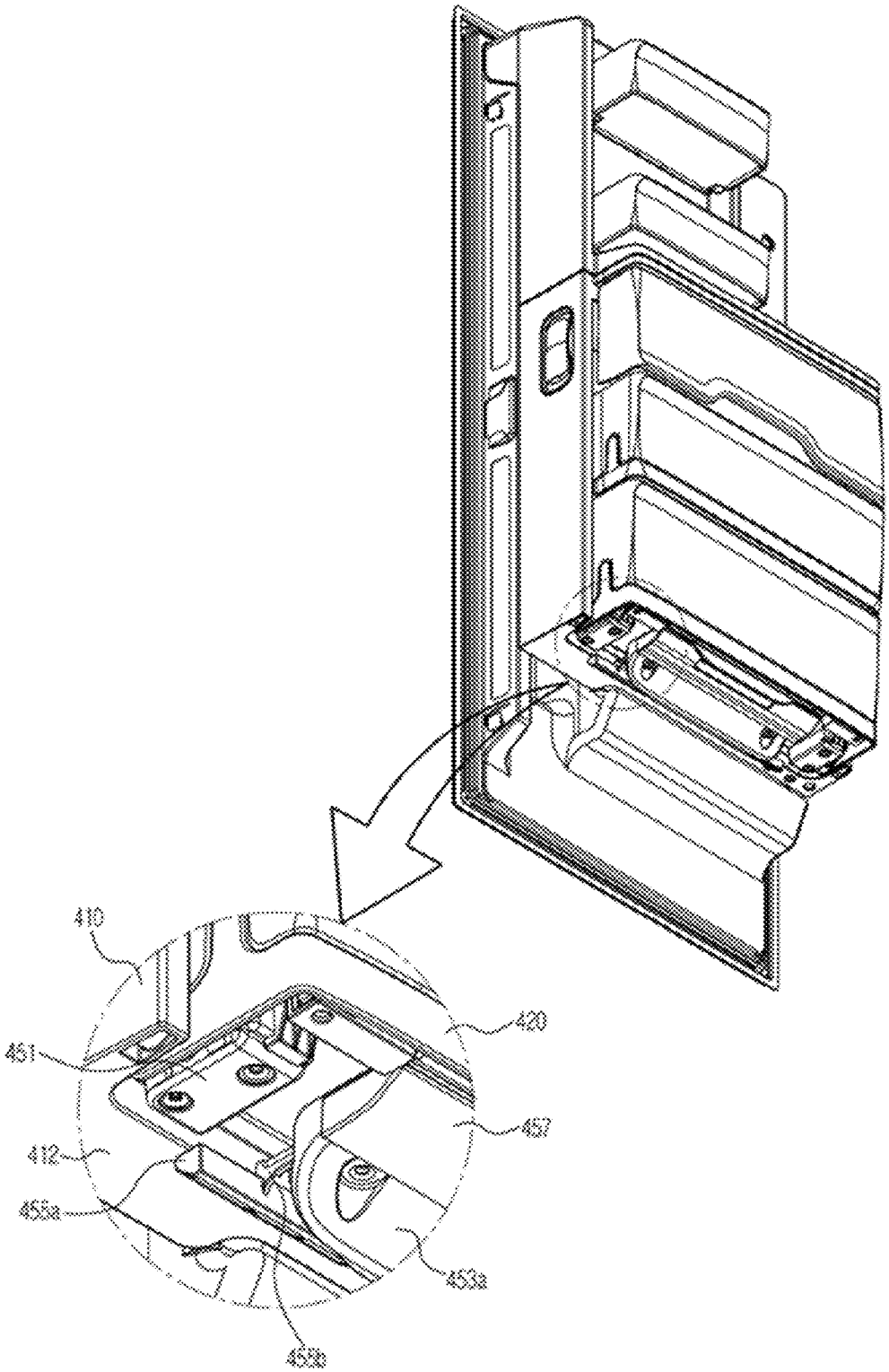
FIGS. 28, 29 and 30 are views of an operation in which the tilting guard assembly of FIG. 24 is rotated by the tilting unit.
Figure 29:
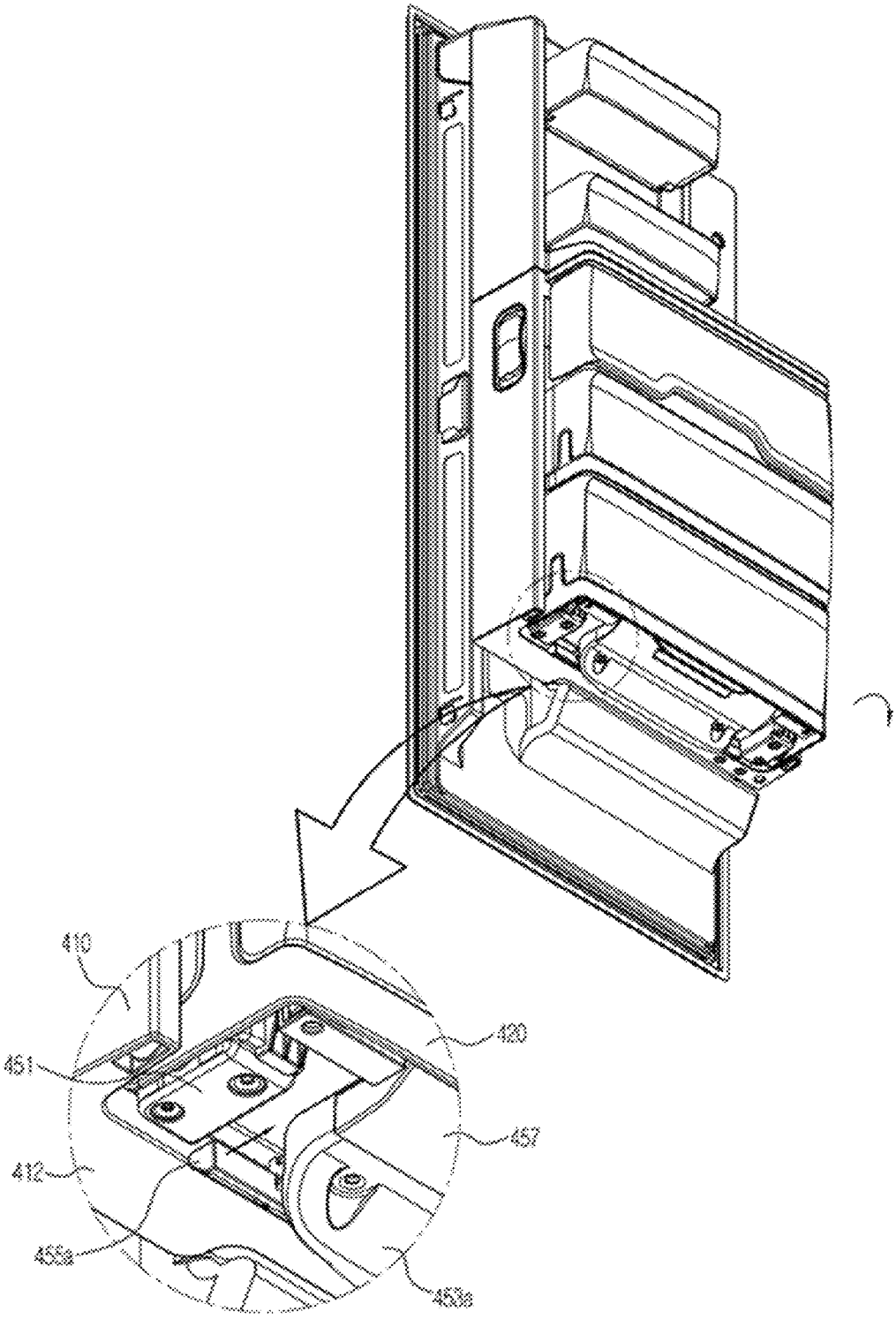
Figure 30:
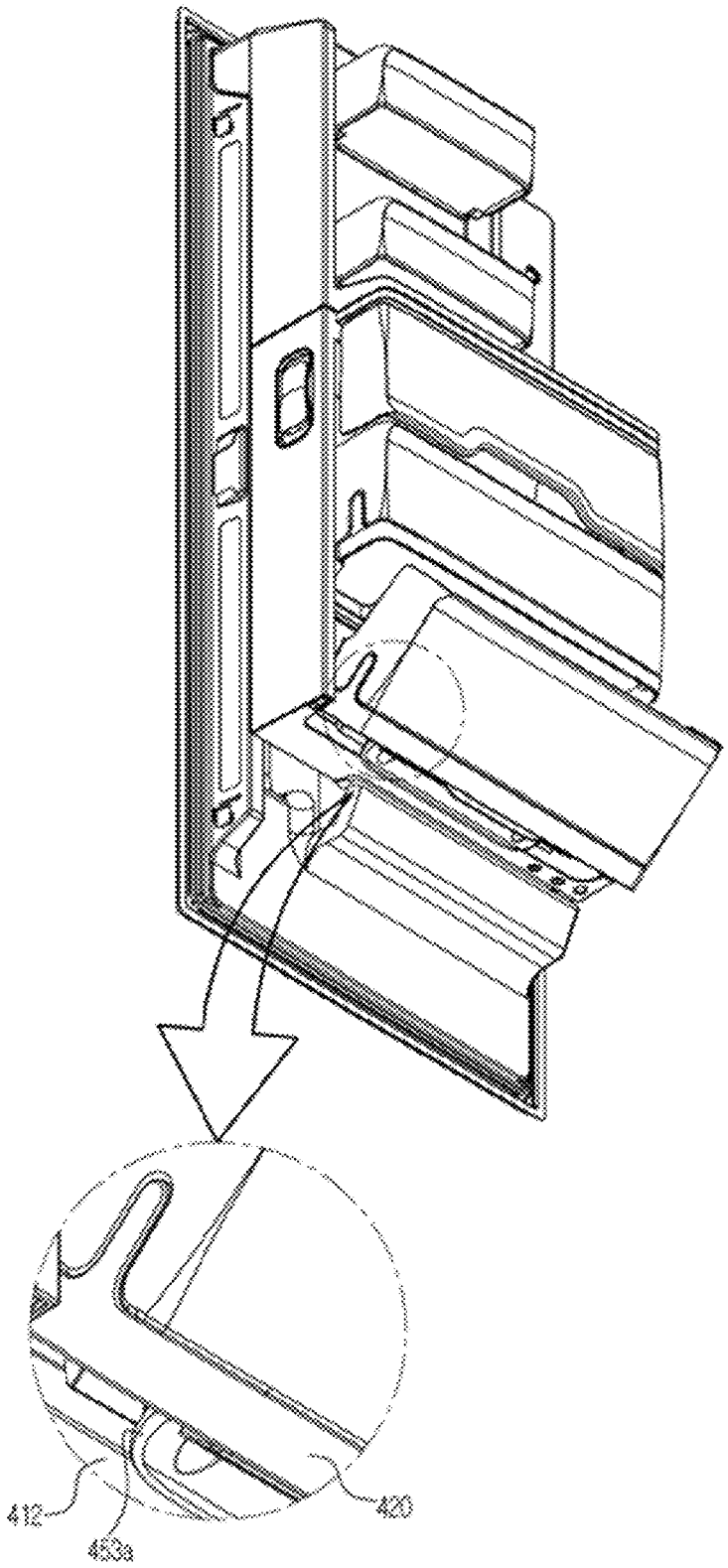

FIGS. 28, 29 and 30 are views of an operation in which the tilting guard assembly of FIG. 24 is rotated by the tilting unit.

The tilting guard assembly 400 is provided so that the tray 420 may be rotated. The tray 420 may be rotated in a state in which the rotation shaft 451*b* of the tilting unit is used as an axis. The tray 420 may be rotated so that the guard portion 430 may open or close the storage space.

Referring to FIG. 28, when the tray 420 is maintained in a closed state, the second tilting hanging portion 455*a* is provided to support a bottom surface 412 of the tilting body portion. The second tilting hanging portion 455*a* may prevent the tray 420 from being rotated when the second tilting hanging portion 455*a* is hung in the bottom surface 412 of the tilting body portion and may maintain the guard portion 430 in the closed state.

Referring to FIG. 29, when the user pulls the handle member 457 toward the front of the tilting guard assembly, the second tilting hanging member 455 connected to the handle member 457 is moved in a forward direction. Thus, the second tilting hanging portion 455*a* does not support the bottom surface 412 of the tilting body portion, and the tray 420 may be rotated so that the guard portion 430 can be opened. In an embodiment of the present invention, since the rotation shaft 451*b* is placed in rear of the tray 420, when the second tilting hanging portion 455*a* does not support the bottom surface 412 of the tilting body portion, the tray 420 is provided to be automatically rotated.

Referring to FIG. 27, the tray 420 cannot be rotated at a particular angle or more. When the tray 420 is rotated at the particular angle or more, the hanging groove of the rotation shaft 451*b* is hung in one side of the rotation adjustment grooves 411*a* of the fixed holes 411 so that rotation of the tray 420 may be limited.

Also, referring to FIG. 30, when the tray 420 is rotated at the particular angle or more, the first tilting hanging portion 453*a* of the first tilting hanging member 453 is hung in the bottom surface 412 of the tilting body portion. Thus, the tray 420 may be provided not to be rotated at a predetermined angle or more.

In this way, the tilting guard assembly 400 may be provided so that, when the user pulls the handle member 457, the tray 420 is rotated up to the predetermined particular angle and then stops.

Also, the user may move the tray 420 and the guard portion 430 to a position in which the storage space is closed. When the user moves the tray 420 and the guard portion 430 to the position in which the storage space is closed, the first tilting hanging portion 453*a* is moved backwards due to the restoration member 456, and a position in which the bottom surface 412 of the tilting body portion is supported, is also moved. Thus, the tray 420 may be provided to stop in the position in which the storage space is closed.

Hereinafter, another embodiment of the tilting guard assembly will be described.

Figure 31:
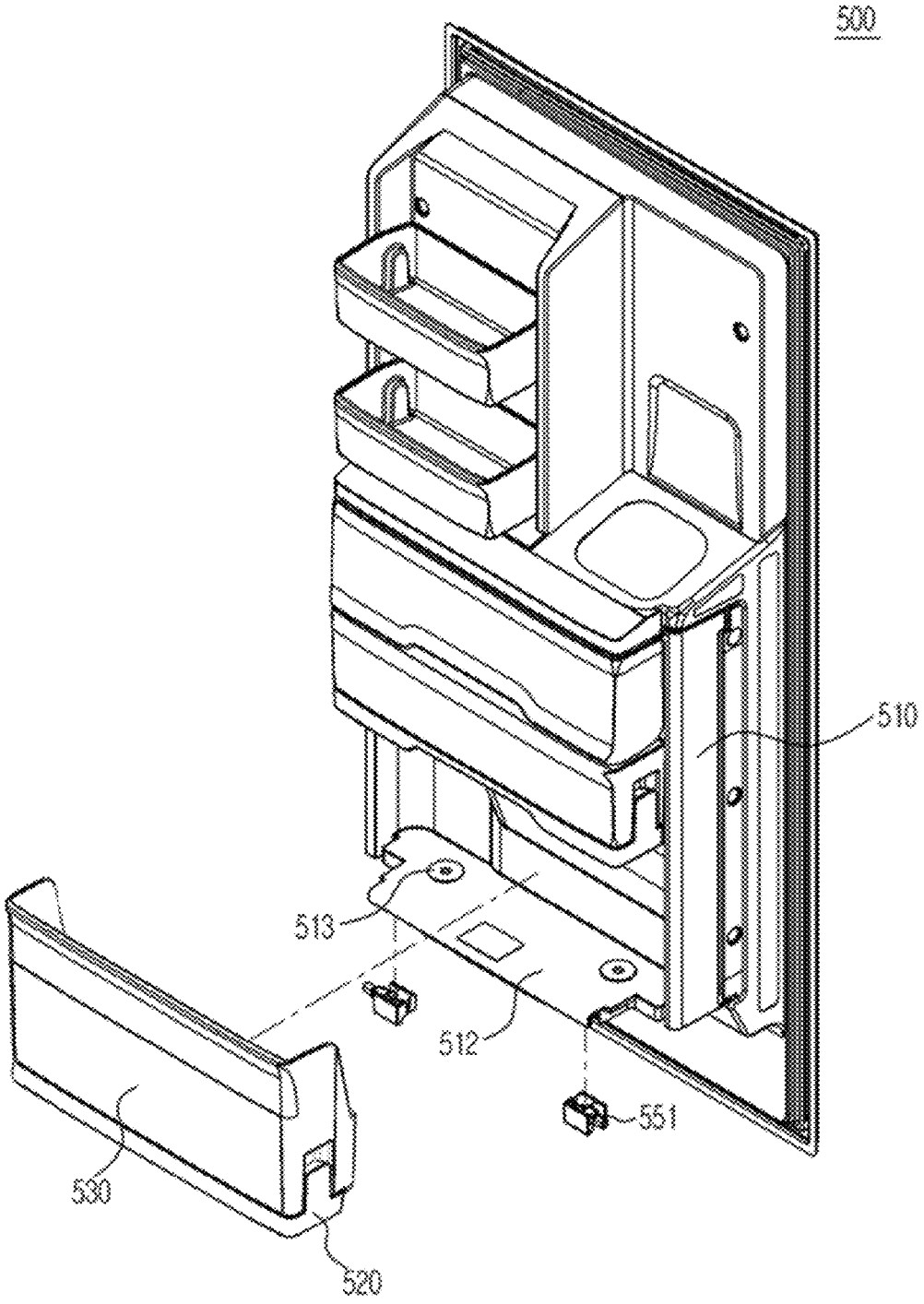
FIG. 31 is a top exploded perspective view of a tilting guard assembly in accordance with an embodiment.
Figure 32:
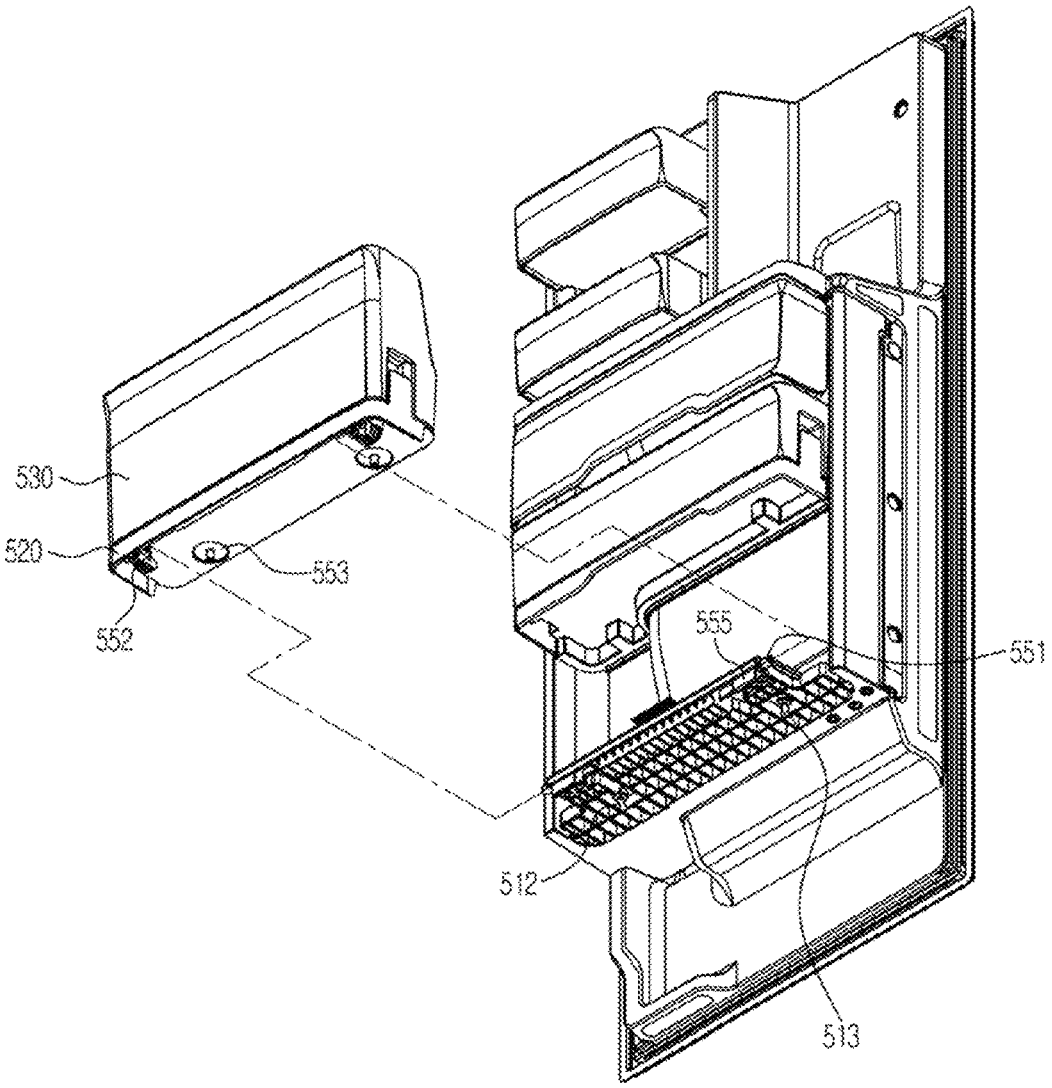
FIG. 32 is a bottom exploded perspective view of the tilting guard assembly of FIG. 31.

FIG. 31 is a top exploded perspective view of a tilting guard assembly in accordance with another embodiment of the present invention, and FIG. 32 is a bottom exploded perspective view of the tilting guard assembly of FIG. 31.

Referring to FIGS. 31 and 32, a tilting guard assembly 500 in accordance with another embodiment of the present invention includes a tilting body portion 510, a tray 520, a guard portion 530, and a tilting unit 550.

The tilting body portion 510 is coupled to a rear side of a door. A rear side of the tilting body portion 510 is provided to be in contact with a rear plate 21*b* of the door 21. The tilting body portion 510 is coupled to the tray 520 and the guard portion 530 and constitutes a storage space.

According to an example, the tilting body portion 510 may include a tray support portion 512. The tray support portion 512 may be provided to extend from a bottom end of the tilting body portion 510 forwards. The tray support portion 512 may be provided in the form of a flat plate in which a top surface of the tray support portion 512 is flat.

Buffer holes 513 may be provided in one side of a top surface of the tray support portion 512. A plurality of buffer holes 513 may be provided. The buffer holes 513 may provide a space in which a buffer portion 553 that will be described later is inserted. According to an example, the buffer holes 513 may include a material having elasticity.

The tray 520 may be provided in the form of a flat plate having a predetermined thickness. The tray 520 may constitute the storage space in the rear side of the door together with the tilting body portion 510. Food placed in the storage space of the rear side of the door is put on the tray 520. According to an example, a plurality of trays 520 may be provided.

The guard portion 530 constitutes the storage space together with the tray 520 and the tilting body portion 510. The guard portion 530 may include a front guard portion and a side guard portion formed to be bent from both ends of the front guard portion in a backward direction of the storage space. A bottom surface of the guard portion 530 may be provided to be fixed to a front end of a top surface and both sides of the tray 520.

The guard portion 530 may be formed of a transparent material so that food placed in the storage space can be seen from the outside.

The tilting unit 550 may include a tilting rotation shaft 551, a rotation shaft coupling portion 552, the buffer portion 553, and a rotation hanging jaw 555.

The tilting rotation shaft 551 may be installed at a bottom surface of the tray support portion 512. The tilting rotation shaft 551 may be placed in front of the bottom surface of the tray support portion 512. Two tilting rotation shafts 551 may be provided in a symmetrical position of the tray support portion 512. The tilting rotation shafts 551 may be provided to protrude from the bottom surface of the tray support portion 512 toward a left side and a right side of the tray support portion 512.

The rotation shaft coupling portion 552 may be installed in front of the bottom surface of the tray 520. The rotation shaft coupling portion 552 is coupled to the tilting rotation shaft 551 and provides a space in which the tilting rotation shaft 551 may be rotated.

The buffer portion 553 may be installed at one side of the bottom surface of the tray 520. The buffer portion 553 may be provided in a position in which the buffer portion 553 overlaps the buffer holes 513 placed in a top surface of the tray 520, when viewed from an upward direction. In detail, the buffer portion 553 is provided in a state in which the buffer holes 513 are inserted, when the storage space is maintained in a closed state. Thus, the tray 520 may be maintained in a stopped state in a state in which the storage space is closed.

The rotation hanging jaw 555 may be installed at one side of the front of the bottom surface of the tray support portion 512. One end of the rotation hanging jaw 555 may be coupled to the bottom surface of the tray support portion 512, and the other end of the rotation hanging jaw 555 may extend from the coupled one end downwards. The rotation hanging jaw 555 may control rotation so that the tray 520 may not be rotated at a predetermined angle or more.

Hereinafter, an operation in which the above-described tilting guard assembly 500 is rotated, will be described in detail.

Figure 33:
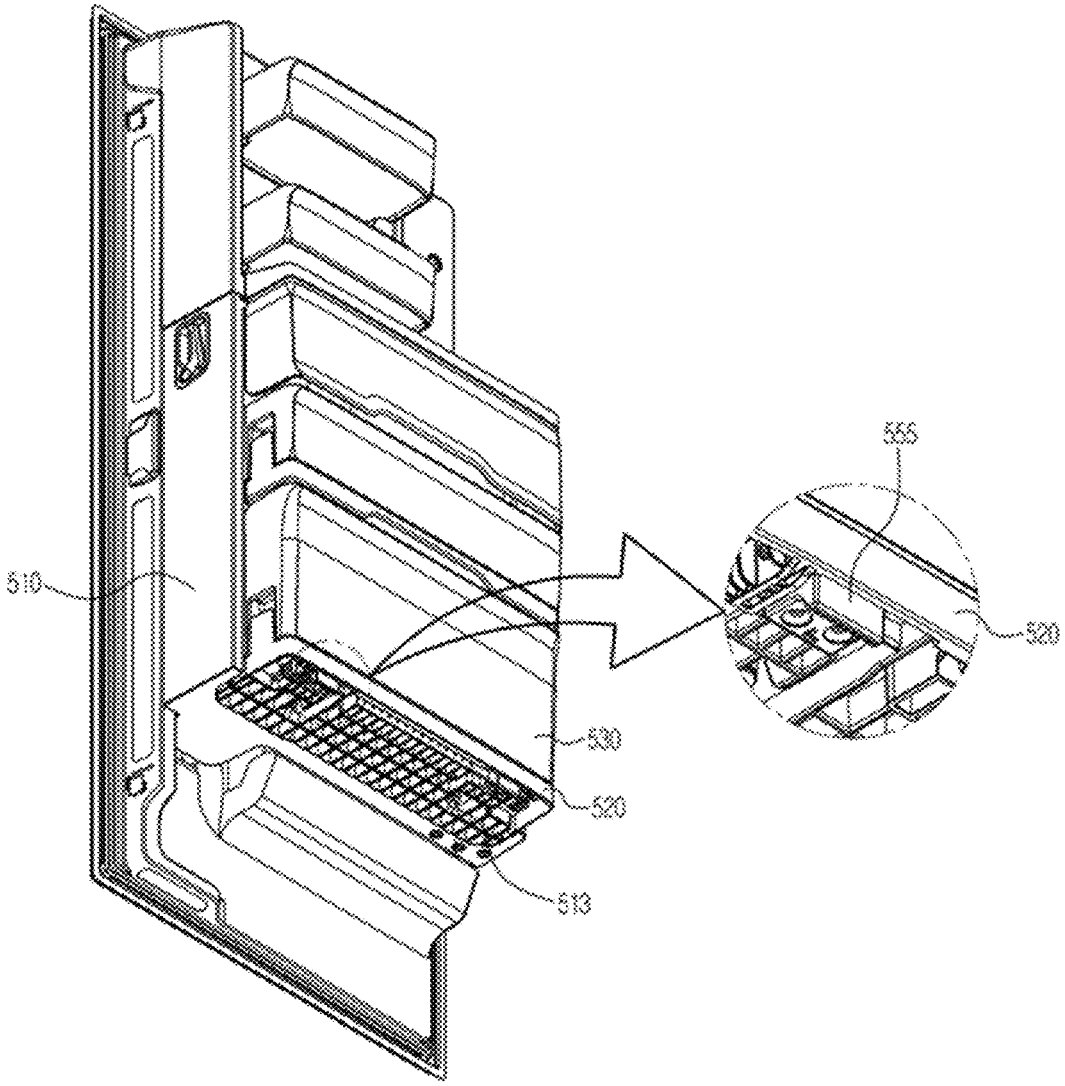
FIGS. 33 and 34 are views of an operation in which the tilting guard assembly of FIG. 31 is rotated by the tilting unit.
Figure 34:
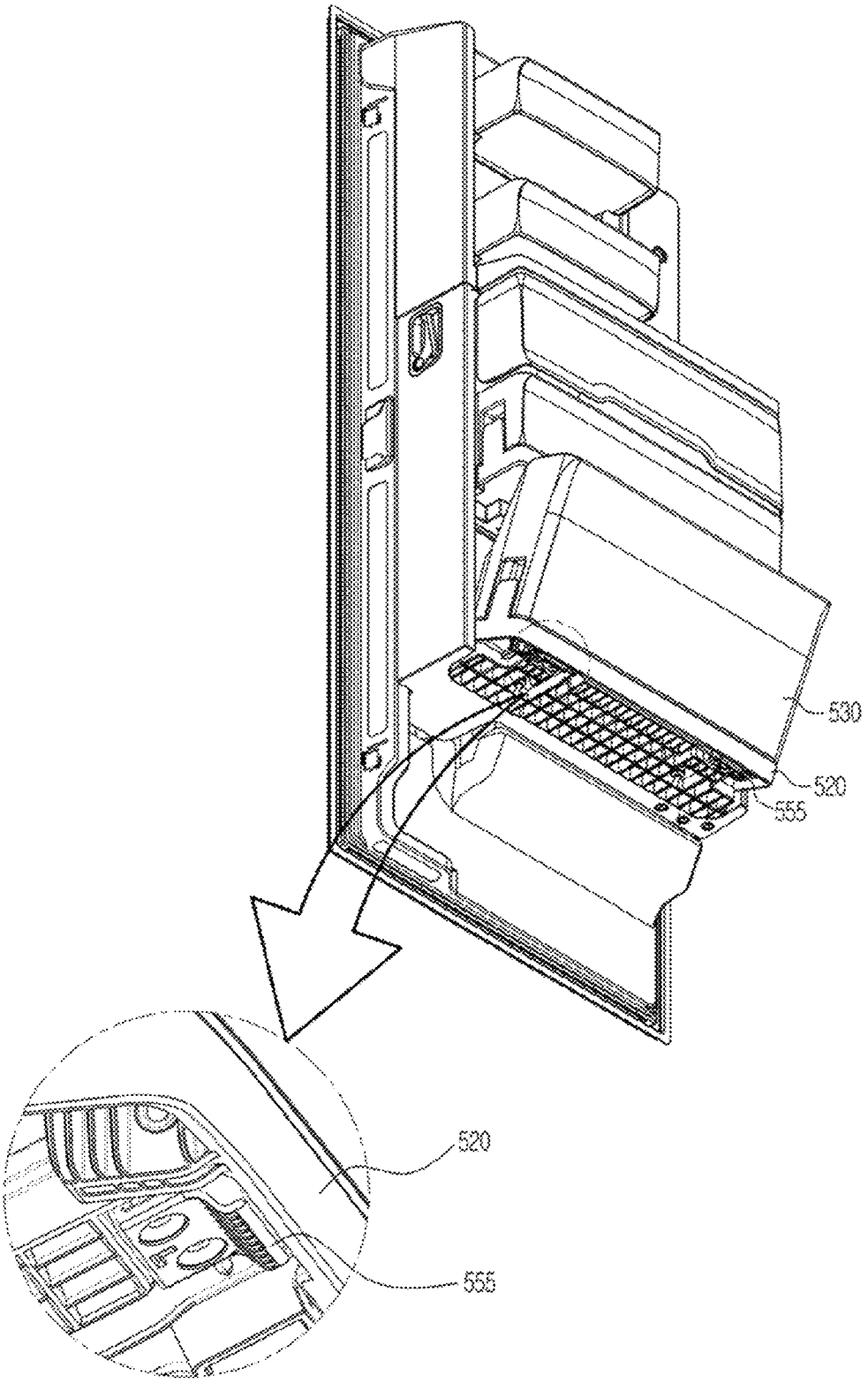

FIGS. 33 and 34 are views of an operation in which the tilting guard assembly of FIG. 31 is rotated by the tilting unit.

The tilting guard assembly 500 is provided so that the tray 520 may be rotated. The tray 520 may be rotated when the tilting rotation shaft 551 of the tilting unit is used as an axis. The tray 520 may be rotated so that the guard portion 530 may open or close the storage space.

Referring to FIG. 33, when the tray 520 is maintained in the closed state, the buffer portion 553 is provided in a state in which the buffer portion 553 is inserted into the buffer holes 513. The buffer portion 553 is provided to be inserted into the buffer holes 513 having elasticity and not to escape from the buffer holes 513 unless the user applies a certain force to the buffer portion 553. Thus, the tray 520 may be maintained in the closed state when no force is transferred from the outside.

Also, since the tilting rotation shaft 551 is placed in front of the tray 520, the tray 520 has a structure in which an external force is not provided to the tray 520 and the tray 520 is not easily automatically rotated.

Referring to FIG. 34, when the user applies a force to the guard portion 530 or the tray 520, the guard portion 530 and the tray 520 can be rotated. When the buffer portion 553 escapes from the buffer holes 513 due to the force applied by the user, the guard portion 530 and the tray 520 may be rotated.

The rotation hanging jaw 555 is hung in a bottom surface of a front end of the tray 520 if the tray 520 is rotated at a particular angle or more. Since the tray 520 is rotated relative to the tray support portion 512 when the tilting rotation shaft 551 is used as an axis, if the tray 520 is rotated at the particular angle or more, the rotation hanging jaw 555 in the stopped state is hung in the bottom surface of the front end of the tray 520. In this way, rotation of the tray 520 may be limited.

Figure 35:
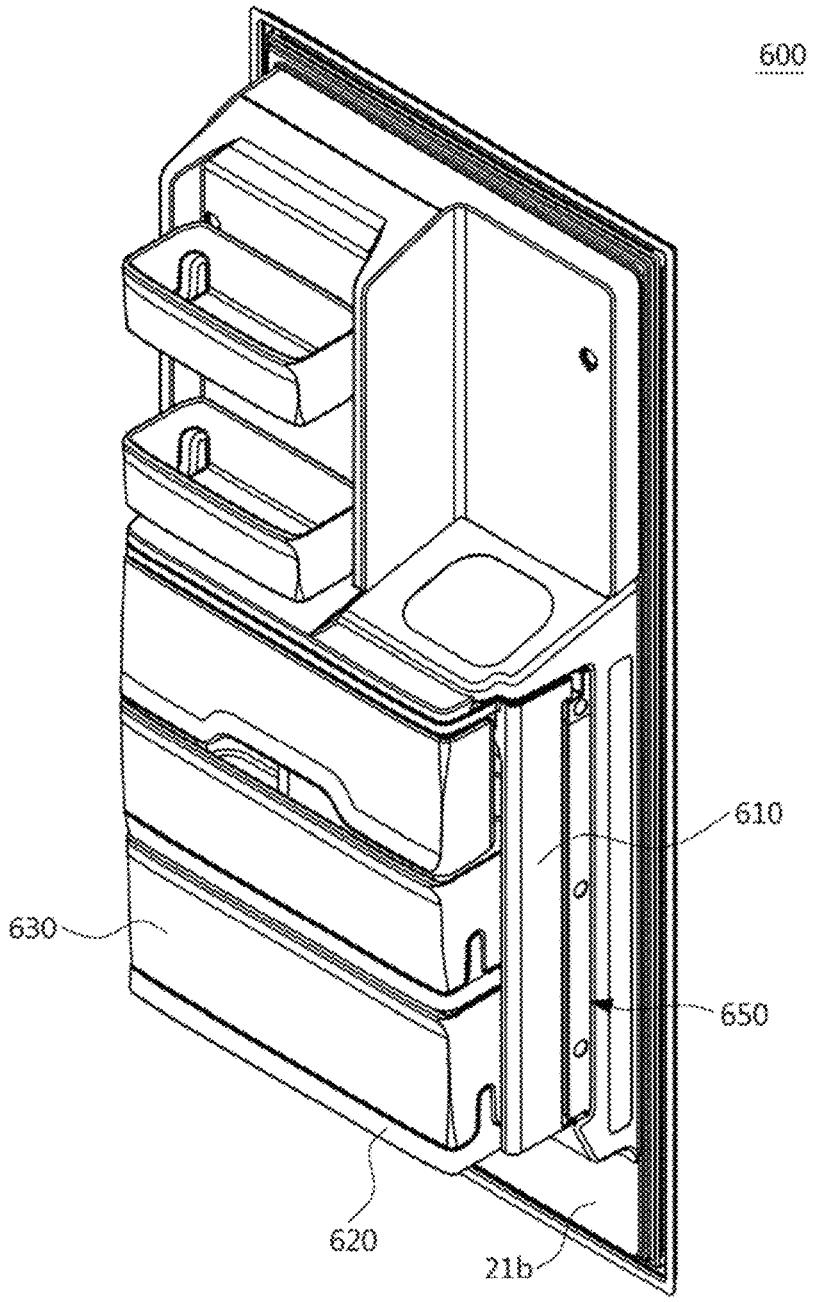
FIG. 35 is a perspective view of a guard assembly of the refrigerator of FIG. 2, in accordance with an embodiment.
Figure 36:
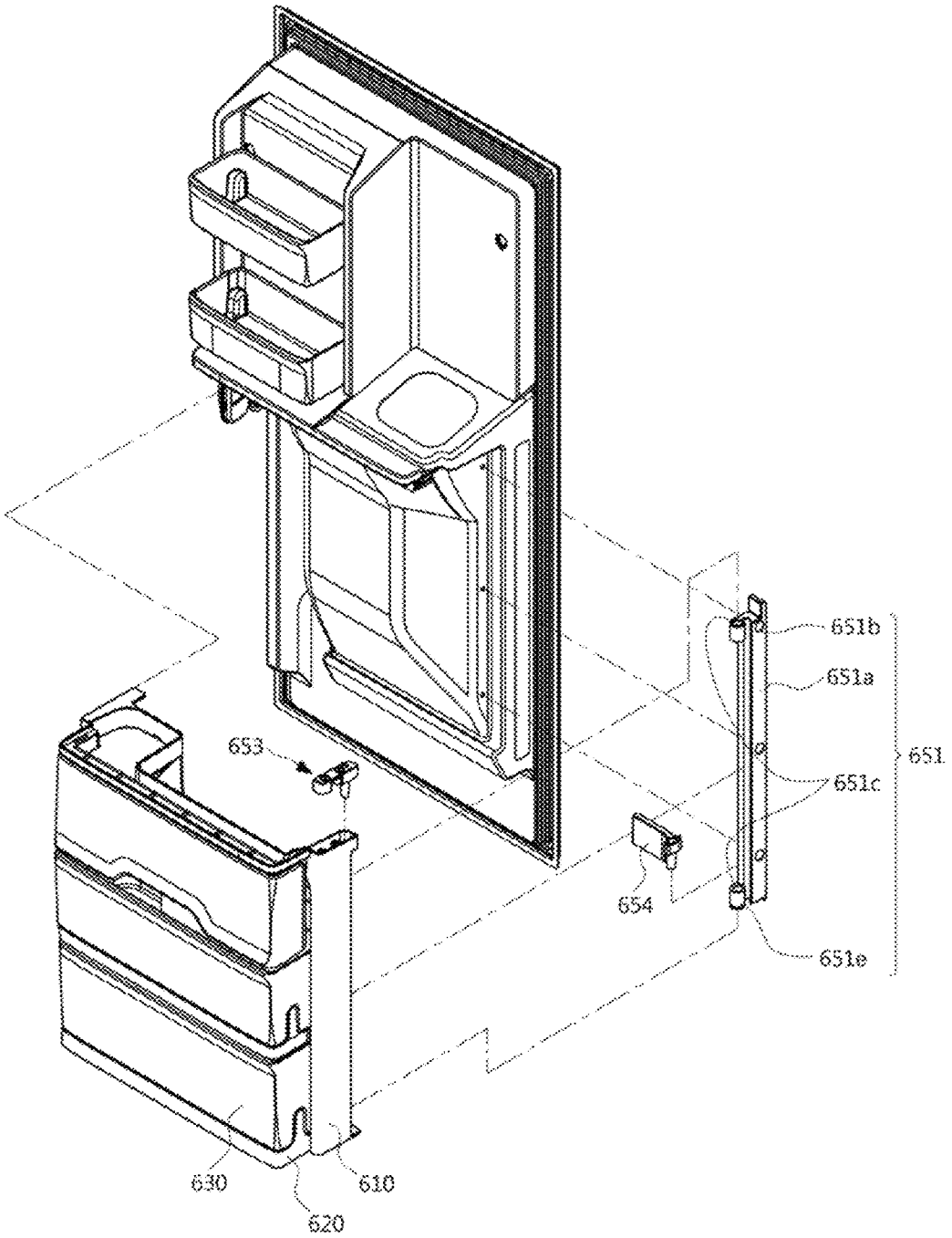
FIG. 36 is an exploded perspective view of the guard assembly of FIG. 35.
Figure 37:
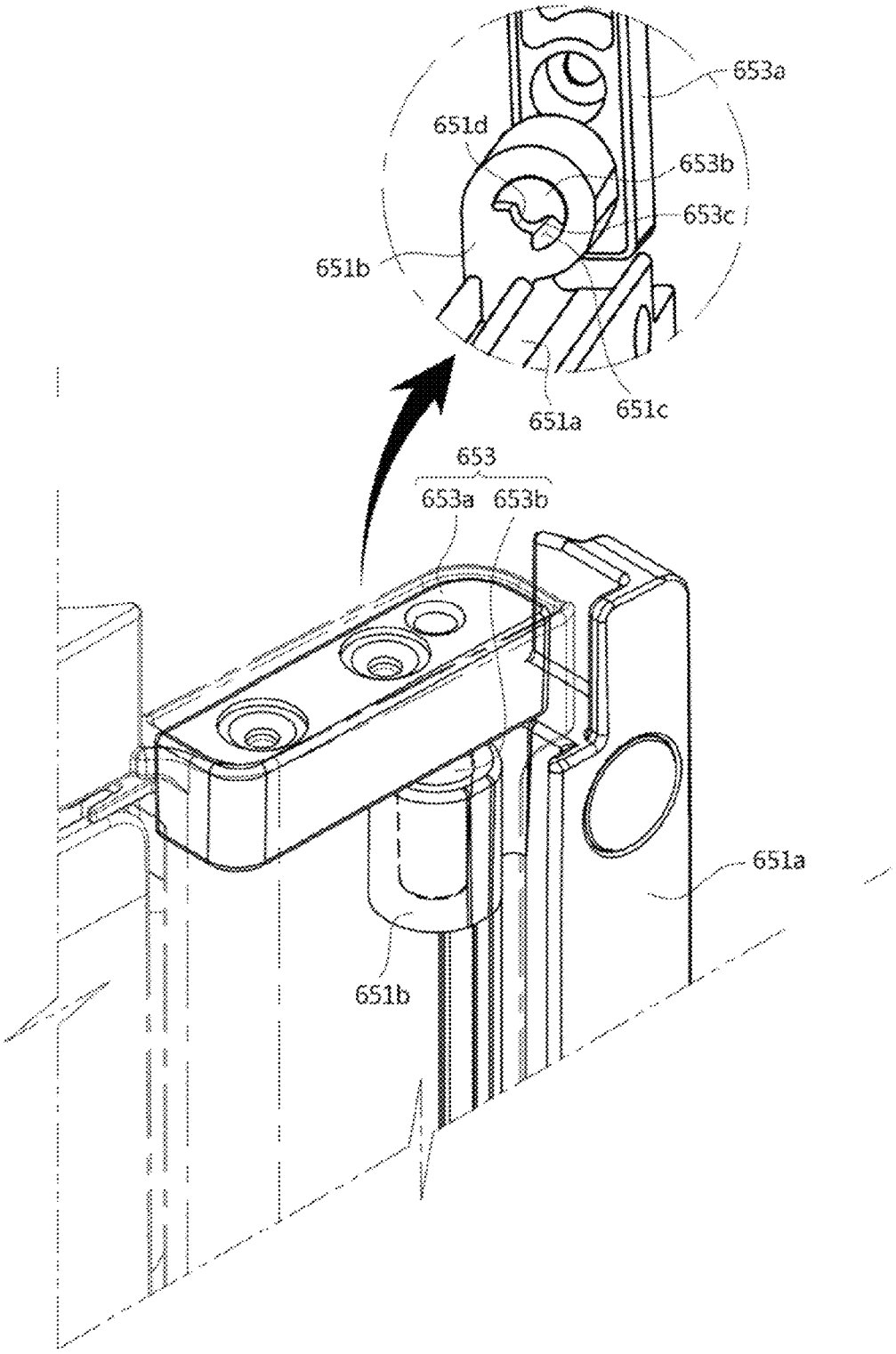
FIG. 37 is an enlarged view of a state in which a body portion of the guard assembly of FIG. 36 is hinge-coupled to a guide member.
Figure 38:
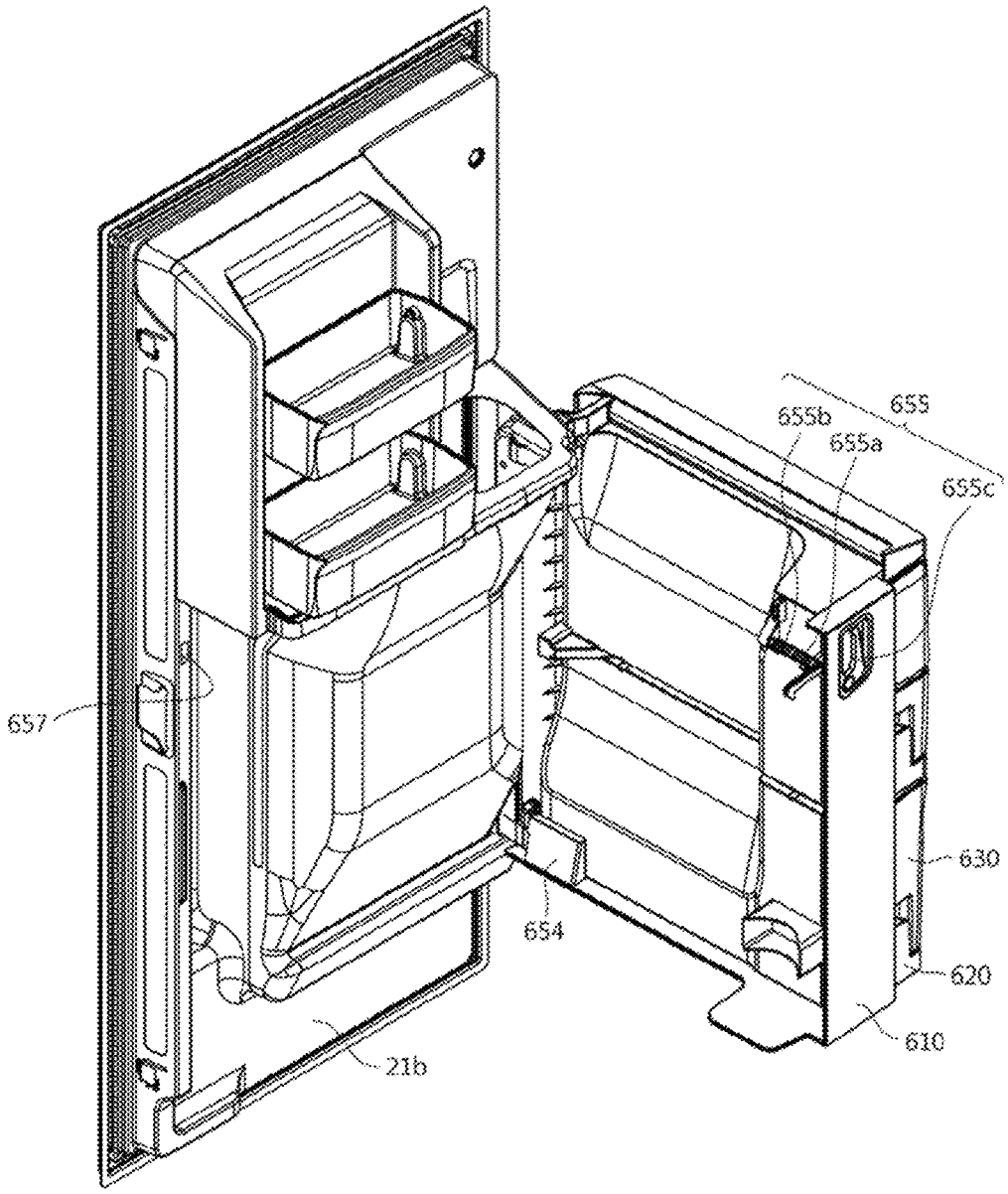
FIG. 38 is a view of a state in which the guard assembly of FIG. 35 is rotated.

FIG. 35 is a perspective view of a guard assembly of the refrigerator of FIG. 2, in accordance with an embodiment of the present invention, and FIG. 36 is an exploded perspective view of the guard assembly of FIG. 35, and FIG. 37 is an enlarged view of a state in which a body portion of the guard assembly of FIG. 36 is hinge-coupled to a guide member, and FIG. 38 is a view of a state in which the guard assembly of FIG. 35 is rotated.

Referring to FIGS. 35, 36, 37 and 38, a guard assembly 600 may include a body portion 610, a tray 620, and a guard portion 630.

The guard assembly 600 is coupled to a rear plate 21*b* of a door 21 and is placed in a refrigerator compartment when the door 21 is closed. According to an example, the guard assembly 600 may be provided to be rotated around one side coupled to the rear plate 21*b* of the door 21.

The body portion 610 is coupled to a rear side of the door 21. The body portion 610 is provided so that a rear side of the body portion 610 is in contact with the rear plate 21*b* of the door 21. According to an example, the body portion 610 may be coupled to the rear side of the door 21 so that a space in which a carbonated water making device may be placed, may be provided between the rear side of the door 21 and the body portion 610.

The tray 620 may be installed at the body portion 610. The tray 620 may be provided so that food may be supported on the tray 620. A plurality of trays 620 may be provided.

The guard portion 630 may be provided to extend from the tray 620 upwards. The guard portion 630 may constitute a storage space in which food is stored, together with the tray 620. The guard portion 630 may be provided with the same number as that of the trays 620.

As illustrated in FIGS. 35 and 36, the guard assembly 600 may further include a rotation unit 650. The rotation unit 650 may cause the body portion 610 to be coupled to the rear plate 21*b* of the door 21 to be rotatable from the door 21. Thus, the body portion 610 may be rotatably coupled to the rear plate 21*b* of the door 21 when the rotation unit 650 is used as an axis.

The rotation unit 650 may include a guide member 651. The guide member 651 may include a guide body 651*a* and coupling portions 651*b* and 651*e*.

The guide body 651*a* may be coupled to one side of the rear plate 21*b* of the door 21. The guide body 651*a* may be coupled to one side of the rear plate 21*b* of the door 21 in a vertical direction. Thus, the body portion 610 may be rotated around the guide member 651.

The coupling portions 651*b* and 651*e* may be installed at the guide body 651*a*. According to an example, the coupling portions 651*b* and 651*e* may be provided at an upper portion and a lower portion of the guide body 651*a*. A coupling hole 651*c* may be formed in each of the coupling portions 651*b* and 651*e* so that one side of the body portion 610 may be rotatably coupled to the coupling portions 651*b* and 651*e* through the coupling holes 651*c*.

The coupling portions 651*b* and 651*e* may include a first coupling portion 651*b* and a second coupling portion 651*e*. The first coupling portion 651*b* may be placed at an upper portion of the guide body 651*a*. The second coupling portion 651*e* may be placed at a lower portion of the guide body 651*a*. The first coupling portion 651*b* and the second coupling portion 651*e* may be disposed in a position in which the first coupling portion 651*b* and the second coupling portion 651*e* overlap each other, when viewed from an upward direction. The first coupling portion 651*b* and the second coupling portion 651*e* may have the coupling hole 651*c* respectively.

As illustrated in FIG. 37, a hanging portion 651*d* may be formed in the coupling hole 651*c*. The hanging portion 651*d* may be formed at an inside of the coupling hole 651*c* and may limit an angle at which hinge members 653 and 654 which will be described below are inserted into the coupling hole 651*c* and are rotated.

The rotation unit 650 may further include the hinge members 653 and 654. The hinge members 653 and 654 may be coupled so that the body portion 610 may be rotated. In detail, one side of each of the hinge members 653 and 654 may be coupled to the body portion 610, and the other side thereof may be rotatably coupled to the coupling hole 651*c*.

The hinge members 653 and 654 may include a first hinge 653 and a second hinge 654. One side of the first hinge 653 may be coupled to an upper portion of the body portion 610, and the other side of the first hinge 653 may be rotatably coupled to the first coupling portion 651*b*.

The first hinge 653 may include a first hinge body 653*a* and a first hinge coupling portion 653*b*. The first hinge body 653*a* may be coupled to the body portion 610. The first hinge body 653*a* may be coupled to an upper portion of the body portion 610 and may be rotated together with the body portion 610.

The first hinge coupling portion 653*b* may extend from one side of the first hinge body 653*a* and may be rotatably inserted into the coupling hole 651*c* of the first coupling portion 651*b*.

As illustrated in FIG. 37, the first hinge coupling portion 653*b* may have a rotation limitation portion 653*c*. The rotation limitation portion 653*c* may be provided so that, when the first hinge coupling portion 653*b* is rotated at a predetermined angle at an inside of the coupling hole 651*c*, the rotation limitation portion 653*c* may be in contact with the hanging portion 651*d* formed in the coupling hole 651*c* and rotation of the first hinge coupling portion 653*b* may be limited. In other words, the rotation limitation portion 653*c* may limit rotation so that the first hinge coupling portion 653*b* may not be rotated at a particular angle or more due to the hanging portion 651*d* placed on a rotation path of the rotation limitation portion 653*c*. Thus, the rotation limitation portion 653*c* may limit rotation of the body portion 610 at the particular angle.

One side of the second hinge 654 may be coupled to a lower portion of the body portion 610, and the other side of the second hinge 654 may be rotatably coupled to the second coupling portion 651*e*.

The second hinge 654 may include a second hinge body and a second hinge coupling portion. The second hinge body may be coupled to the body portion 610. The second hinge body may be coupled to an upper portion of the body portion 610 and may be rotated together with the body portion 610.

The second hinge coupling portion may extend from one side of the second hinge body and may be rotatably inserted into the coupling hole 651*c* of the second coupling portion 651*e*.

The second hinge coupling portion may have a rotation limitation portion. The rotation limitation portion may be provided so that, when the second hinge coupling portion is rotated at a predetermined angle at an inside of the coupling hole 651*c*, the rotation limitation portion may be in contact with the hanging portion 651*d* formed in the coupling hole 651*c* and rotation of the second hinge coupling portion may be limited. Thus, the rotation limitation portion 653*c* may limit rotation of the body portion 610 at the particular angle.

As illustrated in FIG. 38, the rotation unit 650 may further include a lever 655 and a lever groove 657. The lever 655 may be installed in a position of the body portion 610 in which the lever 655 faces the guide member 651. The lever 655 may adjust whether the body portion 610 is coupled to or separated from the rear plate 21*b* of the door 21. The lever 655 may be coupled to or separated from the lever groove 657 installed in one side of the rear plate 21*b* of the door 21 so that the body portion 610 may be coupled to or separated from the rear plate 21*b* of the door 21.

The lever 655 may include a lever coupling portion 655*a*, a restoration member 655*b*, and a handle 655*c*. The lever coupling portion 655*a* may be placed at an inside of the body portion 610 and may be rotatably provided. The lever coupling portion 655*a* may be provided to be hung in the lever groove 657 in a state in which the body portion 610 is coupled to the rear plate 21*b* of the door 21. When the lever coupling portion 655*a* is hung in the lever groove 657, the body portion 610 may be fixed to be coupled to the rear plate 21*b* of the door 21.

The lever coupling portion 655*a* may be rotatably provided to escape from the lever groove 657. Thus, the lever coupling portion 655*a* may be rotated to escape from the lever groove 657 so that the body portion 610 may be separated from the rear plate 21*b* of the door 21.

The restoration member 655*b* may restore a position of the lever coupling portion 655*a* to a predetermined position. In detail, the restoration member 655*b* may restore the lever coupling portion 655*a* to be hung in and fixed to the lever groove 657 when the body portion 610 is coupled to the rear plate 21*b* of the door 21. Thus, when the body portion 610 is in contact with the rear plate 21*b* of the door 21 and is rotated, the lever coupling portion 655*a* may be automatically hung in the lever groove 657 so that the body portion 610 may be fixed to the rear plate 21*b* of the door 21.

The handle 655*c* may be placed at an outside of the body portion 610. The handle 655*c* may be connected to the lever coupling portion 655*a* so as to move a position of the lever coupling portion 655*a*. Thus, the user may move the handle 655*c* so that the body portion 610 may be separated from the rear plate 21*b* of the door 21 and may be rotated.

As described above, the guard assembly 600 in accordance with an embodiment of the present invention may be provided to be rotatable from the rear plate 21*b* of the door 21. The user may move the handle 655*c* so that the guard assembly 600 may be separated from the rear plate 21*b* of the door 21 and may be rotated. If the guard assembly 600 is rotated, the user may open a space between the rear plate 21*b* of the door 21 and the guard assembly 600.

Also, the user may manipulate so that the guard assembly 600 may be fixed to the rear plate 21*b* of the door 21 by rotating the guard assembly 600. If the guard assembly 600 is rotated and is in contact with the rear plate 21*b* of the door 21, the lever 655 may be hung in and fixed to the lever groove 657. Thus, the guard assembly 600 may be automatically fixed to and coupled to the rear plate 21*b* of the door 21.

In this way, the guard assembly 600 may be provided to be rotatable from the rear plate 21*b* of the door 21 so that the space between the guard assembly 600 and the rear plate 21*b* of the door 21 may be utilized. In particular, a door in which a carbonated water making device and a dispenser are disposed, requires a space in which a container for supplying carbon dioxide to the rear plate of the door 21 is to be placed. Also, if carbon dioxide is exhausted, the container needs to be replaced with another container so as to continuously supply carbon dioxide.

The container for supplying carbon dioxide may be provided in the space between the guard assembly 600 and the rear plate 21*b* of the door 21. When the container for supplying carbon dioxide is replaced, the guard assembly 600 may be rotated so that the space between the guard assembly 600 and the rear plate 21*b* of the door 21 may be opened/closed. Thus, the guard assembly 600 may also be provided at the rear side of the door 21 in which the dispenser is disposed, and the space between the guard assembly 600 and the rear plate 21*b* of the door 21 may be utilized. Thus, the internal space of the refrigerator can be utilized and thus, the user's convenience can be improved.

As described above, the guard assembly 600 has been described to be installed at the door in which the dispenser is disposed. However, the guard assembly 600 may also be installed at all doors of the refrigerator regardless of installation of the dispenser.

In addition, in the present invention, the refrigerator in which a storage compartment is partitioned off into an upper portion and a lower portion and which has a side-by-side door, has been described. However, this is just for convenience of explanation, and the idea of the present invention may be applied to all types of refrigerators.

As described above, a rear space of a door of a refrigerator can be efficiently utilized.

A guard assembly disposed at a rear side of the door of the refrigerator is rotated and thus, a space between the rear side of the door and the guard assembly can be utilized.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A guard assembly installed at a rear side of a door of a refrigerator, the guard assembly comprising:
- a body portion which is placed at the rear side of the door and to which a supporting tray is coupled; and
- a rotation unit that causes the body portion to be rotatably coupled to the door,
- wherein the rotation unit comprises:
  - a guide member having a coupling hole and coupled to one side of the rear side of the door; and
  - a hinge member having one side coupled to the body portion and another side rotatably coupled to the coupling hole; and
- a tilting hanging member disposed below the supporting tray and configured to move forward or backward independently from a bottom surface of the supporting tray.

2. The guard assembly of claim 1, wherein the guide member comprises:
- a guide body coupled to the one side of the rear side of the door;
- a first coupling portion having the coupling hole and installed at an upper portion of the guide body; and
- a second coupling portion having a coupling hole and installed at a lower portion of the guide body.

3. The guard assembly of claim 2, wherein the first coupling portion and the second coupling portion are disposed in a position in which the first coupling portion and the second coupling portion overlap, when viewed from an upward direction.

4. The guard assembly of claim 2, wherein the hinge member comprises:
- a first hinge having one side coupled to an upper portion of the body portion and another side rotatably coupled to the first coupling portion; and
- a second hinge having one side coupled to a lower portion of the body portion and another side rotatably coupled to the second coupling portion.

5. The guard assembly of claim 2, wherein the hinge member comprises:
- a hinge body coupled to the body portion; and
- a hinge coupling portion that extends from the hinge body and is rotatably inserted into the coupling hole, and
- wherein the hinge coupling portion has a rotation limitation portion that maintains rotation of the body portion at an angle.

6. The guard assembly of claim 5, wherein the coupling hole comprises:
- a hanging portion disposed on a rotation path of the rotation limitation portion, the rotation limitation portion being hung in the hanging portion so that rotation of the body portion is maintained at the angle.

7. The guard assembly of claim 1, wherein the rotation unit comprises:
- a lever that is installed in a position of the body portion in which the lever faces the guide member and the lever adjusts the body portion to be coupled or separated from the rear side of the door.

8. The guard assembly of claim 7, wherein the lever comprises:
- a lever coupling portion that is placed at an inside of the body portion and is provided to be coupled to or separated from one side of the rear side of the door;
- a handle that is disposed at an outside of the body portion and moves a position of the lever coupling portion; and
- a restoration member that restores the position of the lever coupling portion to a position.

9. A refrigerator, comprising:
- a body including an inner case and an outer case;
- a storage compartment which is placed at an inside of the body and having a front side enabled to open;
- a door that opens/closes the front side of the storage compartment; and
- a guard assembly installed at a rear side of the door,
- wherein the guard assembly comprises:
  - a body portion which is placed at the rear side of the door and to which a supporting tray is coupled; and
  - a rotation unit that causes the body portion to be rotatably coupled to the door,
- wherein the rotation unit comprises:
  - a guide member having a coupling hole and coupled to one side of the rear side of the door; and
  - a hinge member having one side coupled to the body portion and another side rotatably coupled to the coupling hole; and
- a tilting hanging member disposed below the supporting tray and configured to move forward or backward independently from a bottom surface of the supporting tray.

10. The refrigerator of claim 9, wherein the guide member comprises:
- a guide body coupled to the one side of the rear side of the door;
- a first coupling portion having the coupling hole and installed at an upper portion of the guide body; and
- a second coupling portion having a coupling hole and installed at a lower portion of the guide body.

11. The refrigerator of claim 10, wherein the first coupling portion and the second coupling portion are disposed in a position in which the first coupling portion and the second coupling portion overlap, when viewed from an upward direction.

12. The refrigerator of claim 10, wherein the hinge member comprises:
- a first hinge having one side coupled to an upper portion of the body portion and another side rotatably coupled to the first coupling portion; and
- a second hinge having one side coupled to a lower portion of the body portion and another side rotatably coupled to the second coupling portion.

13. The refrigerator of claim 10, wherein the hinge member comprises:

a hinge body coupled to the body portion; and a hinge coupling portion that extends from the hinge body and is rotatably inserted into the coupling hole, and the hinge coupling portion has a rotation limitation portion that maintains rotation of the body portion at an angle.

14. The refrigerator of claim 13, wherein the coupling hole comprises:

a hanging portion disposed on a rotation path of the rotation limitation portion, the rotation limitation portion being hung in the hanging portion so that rotation of the body portion is maintained at the angle.

15. The refrigerator of claim 9, wherein the rotation unit comprises:

a lever that is installed in a position of the body portion in which the lever faces the guide member and the lever adjusts the body portion to be coupled or separated from the rear side of the door.

16. A guard assembly provided to a door of a refrigerator, comprising:

a body portion placed inside the door, the body portion being coupled to a tray to form a storage space; and a movable member configured to cause the body portion to be selectively moved relative to the door using a rotation unit as an axis; and a tilting hanging member disposed below the tray and configured to move forward or backward independently from a bottom surface of the tray.

17. The guard assembly of claim 16, wherein the body portion comprises:

a guard portion that opens and closes the storage space.

18. The guard assembly of claim 16, wherein the body portion is rotatably coupled to a rear plate of the door.

* * * * *